US005779257A

United States Patent [19]

Bonvallet et al.

[11] Patent Number: 5,779,257

[45] Date of Patent: Jul. 14, 1998

[54] AUTOMATIC DAMPING/STIFFENING SYSTEM

[75] Inventors: Duane J. Bonvallet, Ann Arbor, Mich.; Jeffrey R. Bonvallet, Black Forest; John C. Bonvallet, Boulder, both of Colo.

[73] Assignee: Marker Deutschland GmbH, Eschenlohe, Germany

[21] Appl. No.: 639,190

[22] Filed: Apr. 26, 1996

Related U.S. Application Data

[63] Continuation-in-part of Ser. No. 568,156, Dec. 6, 1995, Pat. No. 5,681,054.

[51] Int. Cl.[6] ..... A63C 5/07

[52] U.S. Cl. ..... 280/602; 280/612

[58] Field of Search ..... 280/602, 607, 280/612, 613, 634

[56] References Cited

U.S. PATENT DOCUMENTS

| | | | |
|---|---|---|---|
| 3,398,968 | 8/1968 | Mutzhas | 280/602 |
| 4,865,345 | 9/1989 | Piegay | 280/602 |
| 4,973,073 | 11/1990 | Raines et al. | 280/624 |
| 5,332,252 | 7/1994 | Le Masson et al. | 280/602 |
| 5,397,149 | 3/1995 | Couderc et al. | 280/602 |
| 5,421,602 | 6/1995 | Stepanek et al. | 280/602 |
| 5,499,836 | 3/1996 | Juhasz | 280/602 |

FOREIGN PATENT DOCUMENTS

| | | | |
|---|---|---|---|
| 162372 | 11/1985 | European Pat. Off. | 280/602 |
| 2833393 | 2/1980 | Germany | 280/602 |
| PCT/US94/01049 | of 0000 | WIPO . | |

*Primary Examiner*—Brian L. Johnson
*Assistant Examiner*—Michael Mar
*Attorney, Agent, or Firm*—D. Peter Hochberg; Mark Kusner

[57] ABSTRACT

A system for damping and/or stiffening a ski having a damping member and a stiffening member which are engageable and disengageable through the operation of a switch member. The switch member is engaged by a change in a threshold condition, such as a shift in the skier's weight during skiing. Engagement of the switch member engages the damping member and/or stiffening member. The system maintains the damping member and/or stiffening member in a disengaged condition until the skier commences a turn, engages the damping member and/or the stiffening member during the turn, and disengages the damping member and/or the stiffening member once the turn is completed.

11 Claims, 15 Drawing Sheets

AUTOMATIC DAMPING/STIFFENING SYSTEM

The present invention is a continuation-in-part of U.S. patent application Ser. No. 08/568,156 filed Dec. 6, 1995, now U.S. Pat. No. 5,681,054 entitled CLUTCH ENGAGEABLE DAMPING AND STIFFENING SYSTEM.

FIELD OF THE INVENTION

The present invention relates generally to a part-time damping and/or stiffening system for a ski, and more particularly, to a damping and/or stiffening system for a ski having an automatic switching member for engaging and disengaging a damping and/or stiffening assembly during skiing.

BACKGROUND OF THE INVENTION

A ski will frequently vibrate when skiing on snow due to irregularities in the surface of the ski slope. In this respect, the irregularities in the surface randomly excite various vibration modes of the ski. These vibrations have both beneficial and detrimental effects on skiing. One of the beneficial effects is that vibrating skis impart a lively, responsive, easy-to-control feel to the ski. Furthermore, vibrating skis glide faster than non-vibrating skis. Although the reason for this is not entirely clear, it is thought that the air under the skis may act as a lubricant and/or the reduced interaction with the snow results in less energy loss (as evidenced by shallower ski tracks in the snow). Furthermore, many expert skiers find vibrating skis to be less fatiguing to ski on than non-vibrating skis. Moreover, in the opinion of many expert skiers, it is easier to commence a turn with vibrating skis.

While vibrating skis would appear to always be preferable to non-vibrating skis, vibrating skis do have some drawbacks. In this regard, vibrations can cause a ski to lose contact with the snow, thus impairing the skier's stability on the skis and reducing the skier's ability to hold and guide the ski on the snow. Moreover, vibrating skis have less of the ski edge in contact with the surface of the snow than non-vibrating skis, thus reducing the ability to generate the lateral forces necessary to complete a given turn at high speed. In contrast, a non-vibrating ski provides a longer edge in contact with the surface of the snow, which in turn provides a lower unit loading of the ski edge. This allows the skier to generate higher lateral forces and negotiate a given turn at higher speed. Therefore, while it is easier to commence a turn with a vibrating ski, it is easier to complete a high speed turn with a non-vibrating ski.

Similarly, a stiffened ski provides a firmer ski edge to drive into the snow, than a ski which is not stiffened. Accordingly, turns are more easily executed with a stiffened ski.

In order to reduce or eliminate vibrations, skis are damped. Damping absorbs the vibration energy and converts it to heat. Various systems for damping a ski are available on the market today. One such product is an add-on plate damper, known as the Derbyflex (U.S. Pat. No. 4,856,895; EP 104 185). Add-on plate dampers are mounted on the top surface of the ski. An elastomer damping material is sandwiched between the top surface of the ski and a top plate to which the ski binding is attached. The elastomer damping material provides constrained layer damping. Similar add-on plate dampers are available from other manufacturers.

A second type of damping system is one which is integrated into the ski. In this respect, a layer of damping material is integrated into the sandwiched construction of the ski. This arrangement also provides constrained layer damping, which functions similar to the add-on plate dampers described above.

Another damping system, as described in U.S. Pat. Nos. 5,332,252 and 5,417,448, is built onto the top surface of the ski. The damping system uses a rod securely attached to the top surface of the ski forward of the binding area, and slidingly terminated just forward of the binding against a block of damping elastomer material. The damping elastomer material is deformed in compression. A similar, but shorter, rod and damping member may be installed at the rear of the binding.

Other damping systems incorporate a damping member into ski bindings and ski boots.

Numerous prior art stiffening systems are also available. These systems include stiffening members which are a part of the ski, a part of the ski binding, and a part of the ski boot. Some of the systems allow the stiffness of the ski to be selectively adjusted for various conditions and skiers.

One drawback of prior art damping systems and stiffening systems is that the damping and stiffening occurs continuously (i.e., full time) during skiing. In this respect, no means are provided to disengage the damping and stiffening members during skiing. Therefore, while prior art damping and stiffening systems will provide better holding on icy surfaces and allow for faster turns, they do so at the expense of glide speed and skiing effort.

The present invention overcomes this and other drawbacks of prior art damping and stiffening systems and provides a part-time damping and stiffening system.

SUMMARY OF THE INVENTION

According to the present invention, there is provided a system for damping and stiffening a ski. The system is comprised of damping means having an active condition for damping vibration in a ski, and an inactive condition for lessening the damping of the vibration; stiffening means having an active condition for stiffening the ski against bending and an inactive condition for lessening the stiffening of the ski; and switch means operatively connected to the stiffening means and damping means and have an engaging condition for placing the stiffening means and the damping means in the active condition, and a disengaging condition for placing the stiffening means and the damping means in the inactive condition. The switch means includes a threshold means for maintaining the switch means in one of the engaging condition and disengaging condition, and for enabling the switch means for assuming the other of the disengaging condition and engaging condition upon the occurrence of the threshold condition.

According to yet another aspect of the present invention, there is provided a system for damping a ski comprising damping means having an active condition for damping vibration in the ski, and an inactive condition for lessening the damping of the vibration, switch means operatively connected to the damping means, and having an engaging condition for placing the damping means in active condition and a disengaging condition for placing the damping means in inactive condition. The switch means has threshold means for maintaining the switch means in one of the engaging condition and disengaging condition, and for enabling the switch means for assuming the other of the disengaging condition and engaging condition upon the occurrence of the threshold condition.

According to yet another aspect of the present invention, there is provided a system for stiffening a ski comprising stiffening means having an active condition for stiffening a ski against bending, and an inactive condition for lessening the stiffening of the ski, and switch means operatively connected to the stiffening means and having an engaging condition for placing the stiffening means in the active condition and a disengaging condition for placing the stiffening means in the inactive condition. The switch means includes threshold means for maintaining the switch means in one of the engaging condition and disengaging condition, and for enabling the switch means for assuming the other of the disengaging condition and the engaging condition upon the occurrence of the threshold condition.

According to another aspect of the present invention, there is provided a system for damping a ski comprising damping means for damping vibrations occurring in the ski, and switch means for activating said damping means upon the reception by said switch means of at least a minimum force.

According to another aspect of the present invention, there is provided a system for stiffening a ski comprising stiffening means for stiffening the ski against bending, and stiffening switch means for activating said stiffening means upon the reception by said stiffening switch means of at least a minimum force.

According to still another aspect of the present invention, there is provided a system for controlling vibrations and stiffness in a ski comprising a hydraulic damper for controlling vibrations, spring means for controlling stiffness of the ski, stiffness and damping control means, and switch means. The damper includes a hydraulic cylinder containing hydraulic fluid, a piston movable inside the cylinder and a piston rod connected to the piston, either of the piston and piston rod or the cylinder being fixable to a ski, and the other of the piston and piston rod, and the cylinder, being movable as the ski bends for damping vibrations from the ski. The stiffness and damping control means has a portion fixable to the ski and a portion movable as the ski bends. The stiffness and damping control means is attached to the piston rod for effecting relative movement between the piston and the cylinder when the ski bends. The stiffness and damping control means compresses the spring means as the ski bends to affect the stiffness of the ski. The switch means is operatively connected to the hydraulic damper and spring means; the clutch means activates and deactivates the damper and spring means according to the amount of force exerted on the switch means.

According to yet another aspect of the present invention, there is provided a system for damping and stiffening a ski comprising damping means having an active condition for damping vibration in the ski, and an inactive condition for lessening the damping of the vibration; stiffening means having an active means for stiffening the ski against bending, and an inactive condition for lessening the stiffening of the ski; and switch means operatively connected to the damping means and stiffening means. The switch means have an engaging condition for placing the damping means and stiffening means in the active condition, and a disengaging condition for placing the damping means and stiffening means in the inactive condition. The switch means are responsive to turning of the ski to place the damping means and stiffening means in the inactive condition.

It is an object of the present invention to provide a damping system for damping a ski, having a damping member which is engageable and disengageable depending upon a skiing condition.

It is another object of the present invention to provide a stiffening system for stiffening a ski, having a stiffening member which is engageable and disengageable depending upon a skiing condition.

It is another object of the present invention to provide an automatic switching member for engaging and disengaging a damping member for damping a ski.

It is another object of the present invention to provide an automatic switching member for engaging and disengaging a stiffening member for stiffening a ski.

It is yet another object of the present invention to provide a damping system which uses a shift in the weight of the skier to engage and disengage a damping member.

It is yet another object of the present invention to provide a stiffening system which uses a shift in the weight of a skier to engage and disengage a stiffening member.

It is still another object of the present invention to provide a combined damping/stiffening system which uses a shift in the weight of a skier to engage and disengage a combined damping/stiffening member.

It is another object of the present invention to provide a damping system for a ski having a damping member which is engaged only after the skier has commenced a turn, and is disengaged once the skier has completed the turn.

It is another object of the present invention to provide a system for engaging a stiffening member only after the skier has commenced a turn, and disengages the stiffening member once the turn is completed.

It is yet another object of the present invention to provide a damping/stiffening system for a ski having a damping member and a stiffening member engage only after the skier has commenced a turn, and disengage once the skier has completed the turn.

These and other objects will become apparent from the following description of preferred embodiments taken together with the accompanying drawings and the appended claims.

BRIEF DESCRIPTION OF THE DRAWINGS

The invention may take physical form in certain parts and arrangement of parts, preferred embodiments of which will be described in detail in the specification and illustrated in the accompanying drawings which form a part hereof, and wherein.

DETAILED DESCRIPTION OF THE PREFERRED EMBODIMENT

Reference is now made to the drawings, wherein the showings are for the purpose of illustrating preferred embodiments of the invention only, and not for the purpose of limiting same.

Figure 16:
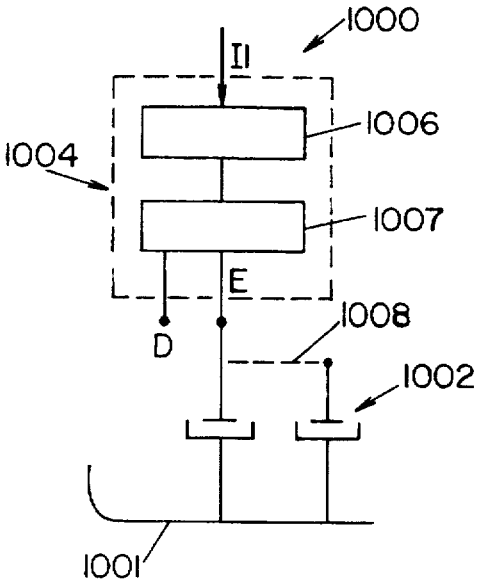
FIG. 16 is a schematic view of a clutched damping system according to a version of the invention.

Considering first FIG. 16, a damping system 1000 is shown. A ski 1001 is illustrated having damping means 1002 operatively connected to the ski. Damping means 1002 alternatively has an active condition for damping the vibration of ski 1001, and an inactive condition for lessening the damping of ski 1001. The lessening of the damping either cannot damp the vibration of the ski at all, or can damp the vibration of the ski by a lower amount than when the damping means is in the active condition. Damping means 1002 is operatively connected to a clutch means 1004. Clutch means 1004 has a threshold means 1006, which receives an input I1. Input I1 could, for example, be an input force. Clutch means 1004 also includes an output portion 1007, which has an engaging condition and a disengaging condition. When the output portion of clutch means 1004 is in its engaging condition, its output is shown symbolically as E, and it puts damping means 1002 in its active condition. When the output portion of clutch means 1004 is in its disengaging condition, its output is shown symbolically as D, and damping means 1002 is in its inactive condition.

When input I1 to threshold means 1006 reaches a threshold value, threshold means 1006 maintains clutch means 1004 in the engaging or disengaging condition; when input I1 falls below (or, depending on the construction, rises above) the threshold value, clutch means 1004 assumes the other of the disengaging or engaging conditions. (Input I1 could alternatively be a minimum force applied to clutch means 1004.)

Damping varying means 1008 can be provided for changing the damping applied to ski 1001. Varying means 1008 can increase or decrease the damping applied to ski 1001.

The damping system shown in FIG. 16 can be included in a binding apparatus, in the ski itself, in the boot connected to the ski, or in combination with the binding apparatus, the ski and/or the boot.

Figure 17:
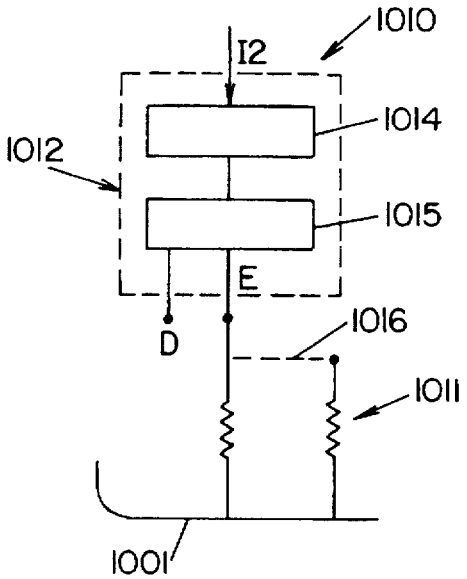
FIG. 17 is a schematic view of a clutched stiffening system according to a version of the invention.

Turning next to FIG. 17, a stiffening system 1010 is depicted. A ski 1001 has stiffening means 1011 operatively connected to the ski. Stiffening means 1011 is shown as biasing means, and has an active condition for stiffening ski 1001 against bending, and an inactive condition for lessening the stiffening of the ski. Lessening the stiffening of the ski can either not stiffen the ski, or can lessen the stiffening of the ski below the stiffening which occurs when stiffening means 1011 is in the active condition. Stiffening means 101 is operatively connected to a clutch means 1012. Clutch means 1012 has a threshold means 1014 which receives an input I2. Input I2 could, for example, be an input force. Clutch means 1012 has an output portion 1015 with an engaging condition and a disengaging condition. When clutch means 1012 is in its engaging condition, it puts stiffening means 1011 in its active condition. When clutch means 1012 is in its engaging condition, its output is shown with the symbol E. When clutch means 1012 is in its disengaging condition, its output is shown with the symbol D.

Clutch means 1012 includes a threshold means 1014. When input I2 meets some threshold value, threshold means 1014 puts output portion 1015 of clutch means 1012 in one of its engaging or disengaging conditions. When input I2 is below (or, depending on its construction, above) the threshold value, clutch means 1012 assumes the other of the disengaging or engaging condition. (Input I2 could be a minimum force applied to clutch means 1012.)

Stiffness varying means 1016 can be employed to change the stiffness applied to ski 1001 by adding (or subtracting) the stiffness applying portion of the stiffness means to ski 1001.

The stiffness system 1010 shown in FIG. 17 can be included in a binding apparatus, a ski and/or in a boot, or in the combination of the binding, ski and/or boot.

Figure 1:
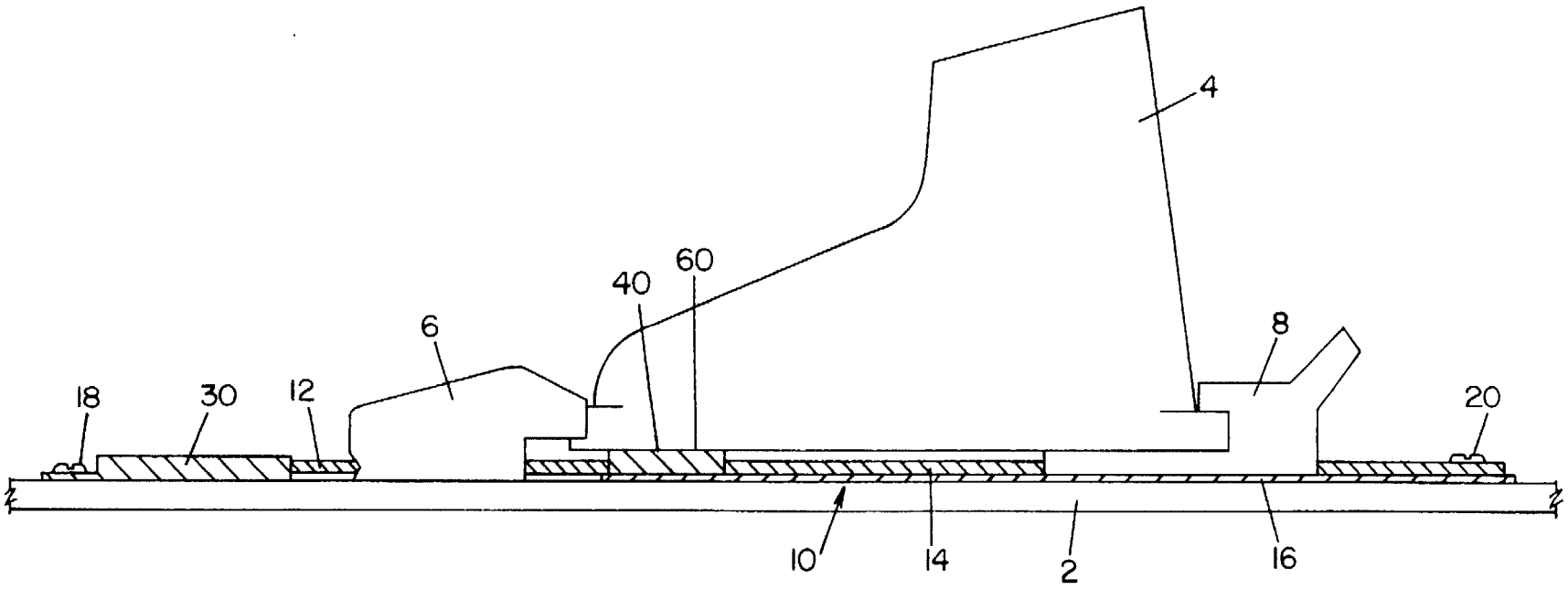
FIG. 1 is a side plan view of the damping system according to a first embodiment of the present invention, as mounted to a ski with a ski binding toe piece, a ski binding heel piece and a ski boot arranged thereon.

FIG. 1 shows a damping system 10 according to one embodiment of the present invention. Damping system 10 is shown mounted to a ski 2 along with a ski binding toe piece 6 and ski binding heel piece 8. Toe piece 6 and heel piece 8 secure a ski boot 4 to ski 2.

According to a first embodiment of the present invention, damping system 10 is generally comprised of a longitudinally extending front damping plate 12, a longitudinally extending rear damping plate 14, a damping member 30 and a clutch 40. Damping member 30 is fixed to ski 2 in front of toe piece 6. In this respect, a fastener or anchor 18 attaches damping member 30 to ski 2. It should be appreciated that damping member 30 may take several forms, including a hydraulic piston and cylinder dashpot, a viscoelastic material deformed in shear or compression, a piezoelectric damper or a friction damper. Furthermore, it is contemplated that damping member 30 may be selectively adjustable to provide varying amounts of damping.

The front end of front damping plate 12 engages with damping member 30. The rear end of front damping plate 12 extends through a slot in toe piece 6 and into clutch housing 60 of clutch 40. Inside clutch housing 60, front damping plate 12 is engageable with rear damping plate 14, as will be discussed below.

The rear end of rear damping plate 14 is fixed to ski 2. In this respect, a fastener or anchor 20 attaches rear damping plate 20 to ski 2. The front end of rear damping plate 14 extends forward through an opening in heel piece 8 and into clutch housing 60, where it is engageable with front damping plate 12. Alternatively, heel piece 8 may be mounted onto the upper surface of rear damping plate 14. According to a preferred embodiment of the present invention, an elongated low-friction sheet 16 is arranged between the upper surface of ski 2 and rear damping plate 14 to reduce friction between rear damping plate 14 and the upper surface of ski 2, as rear damping plate 14 slides longitudinally relative to ski 2. Furthermore, sheet 16 supports rear damping plate 14 at an appropriate height relative to front damping plate 12. The ends of front damping plate 12 and rear damping plate 14 which meet inside clutch housing 60 will be described in detail below.

Figure 4:
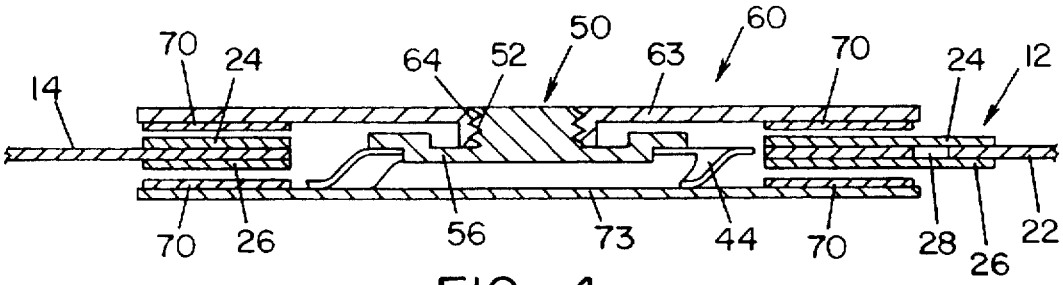
FIG. 4 is a sectional view taken along line 4—4 of FIG. 2.
Figure 5:
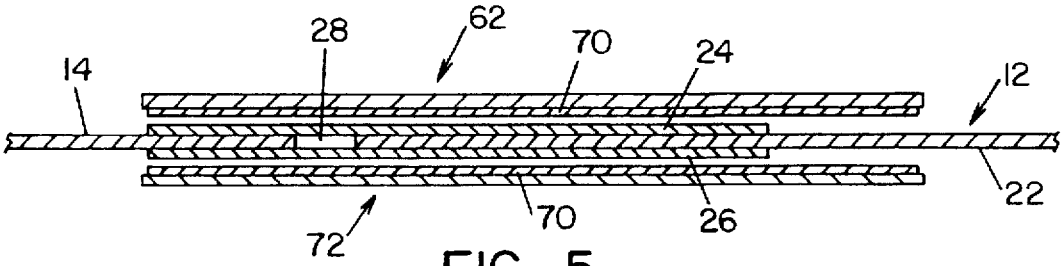
FIG. 5 is a sectional view taken along line 5—5 of FIG. 2.

Front and rear damping plates 12, 14 will now be described according to a first embodiment. As best seen in FIGS. 4 and 5, front damping plate 12 is comprised of a center plate 22 and a pair of parallel plates 24, 26. Parallel plates 24, 26 form a plate-receiving slot 28 dimensioned to receive rear damping plate 14. Preferably, parallel plates 24, 26 are welded or bolted to center plate 22 to form the plate-receiving slot 28. Rear damping plate 14 is comprised of a single planar plate.

It will be appreciated that parallel plates 24, 26 of front damping plate 12 and rear damping plate 14 have an opening therein to accommodate an adjuster 50 and bias means 44, which are described below. This opening is best shown in FIG. 4, whereas FIG. 5 illustrates how rear damping plate 14 meets front damping plate 12 inside clutch housing 60.

Referring now to FIGS. 2–5, clutch 40 will be described in detail according to this embodiment of the present invention. Clutch 40 is generally comprised of a clutch housing 60, a bias means 44 and an adjuster 50. Clutch housing 60 is comprised of an upper portion 62 and a lower portion 72. Upper and lower portions 62, 72 are biased apart by bias means 44. The force exerted by bias means 44 is determined by the adjustment of adjuster 50.

It should be appreciated that bias means 44 may take many forms, including a finger spring washer, a belleville spring washer, a curved spring washer, a wave spring washer, a compression spring, a torsion spring, pneumatic bellows, and the like. For the sole purpose of illustrating a preferred embodiment of the invention, bias means 44 is shown as a finger spring washer in FIGS. 2–5.

Upper portion 62 of clutch housing 60 is comprised of a generally flat central section 63 and a pair of side portions 66. A threaded opening 64 is formed in central section 63 generally along the central transverse axis of housing 60. Side portions 66 extend downward from the side edges of central section 63. Along the lower edge of side portions 66 a lip 68 is formed. Lip 68 is a generally horizontal inward extending portion. The upper surface of lip 68 is operatively engageable with lower portion 72, as will be explained below.

Lower portion 72 is comprised of a generally planar central section 73 and L-shaped shoulders 74, which extends from the side edges of central section 73. L-shaped shoulders 74 are comprised of a vertical section 76 and a horizontal section 78. When upper portion 62 and lower portion 72 are biased apart, the lower surface of horizontal section 78 engages with the upper surface of lip 68.

Adjuster 50 is comprised of a threaded portion 52 and an engaging surface 56. Threaded portion 52 is dimensioned to be received by threaded opening 64 formed in central section 63. A slot 54 is formed at the top of threaded portion 52 to allow for easy rotation of adjuster 50 using a screwdriver, coin or other similarly shaped object. Rotating adjuster 50 so that it moves downward increases the preloading force exerted by bias means 44 on clutch housing 60. Likewise, rotating adjuster 50 so that it moves upward decreases the preloading force exerted by bias means 44 on clutch housing 60. Engaging surface 56 is a generally planar disk-shaped surface, which is dimensioned to engage with bias means 44.

A coating 70 of a low friction material (e.g., Teflon®) is applied to the lower surface of central section 63 of upper portion 62 and to the upper surface of central section 73 of lower portion 72, where housing 60 is engageable with front damping plate 12 when clutch 40 is engaged. The purpose of coating 70 is to reduce friction between clutch housing 60 and front damping plate 12 when clutch 40 is engaged, as will be explained in detail below.

Figure 2:
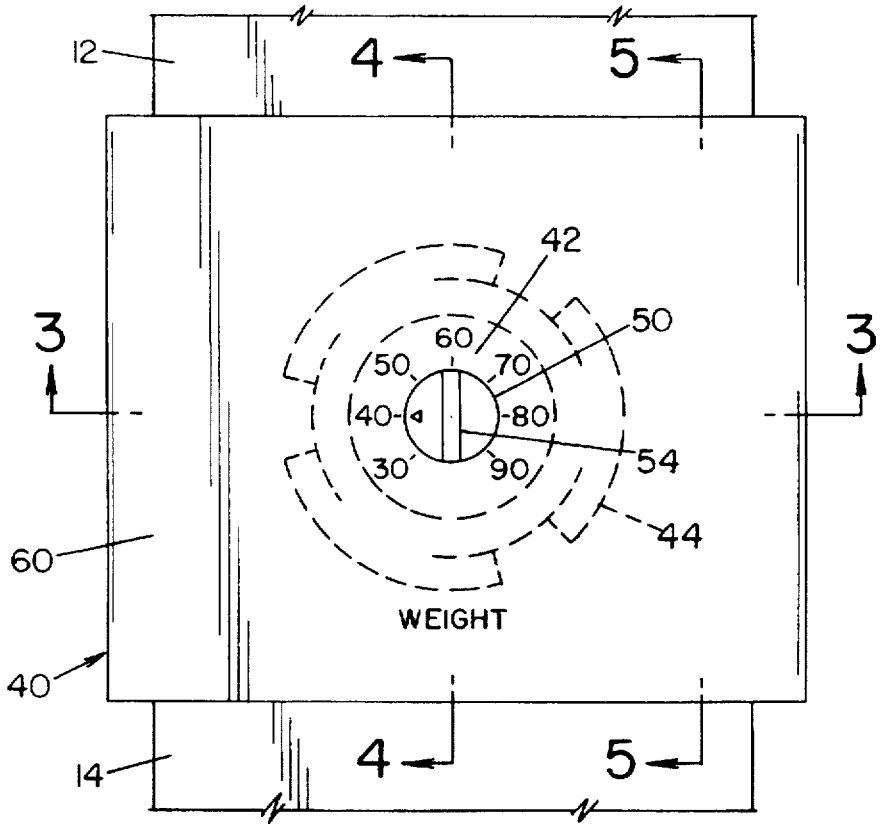
FIG. 2 is a top plan view of the clutch means of FIG. 1.
Figure 3:
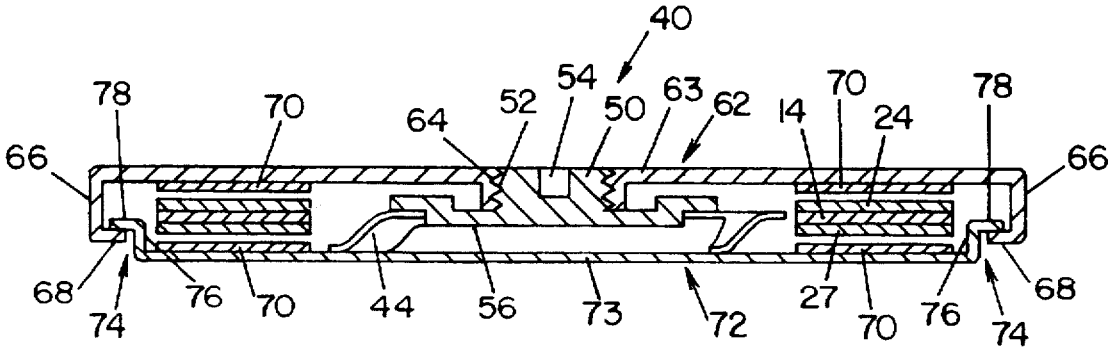
FIG. 3 is a sectional view taken along line 3—3 of FIG. 2.

The operation of damping system 10 will now be described with reference to FIGS. 1–3. Before boot 4 is secured to ski 2 by engagement with toe piece 6 and heel piece 8, adjuster 50 is adjusted to preload bias means 44 to approximately one-half the skier's weight. Therefore, when the skier exerts a force which exceeds the preloading force of bias means 44, upper portion 62 moves downward to engage clutch 40. It should be understood that the skier will shift weight to the downhill ski and to the toe end of their foot after they commence turning the ski. The skier's weight will remain shifted until the turn is completed. Thereafter, the skier's weight will shift away from the toe end of the foot and away from the downhill ski. Accordingly, clutch 40 will be engaged after a turn is commenced and will be disengaged once the turn is completed. Therefore, damping will be provided only on an interval or part-time basis.

When clutch 40 is engaged, front damping plate 12 engages with rear damping plate 14. In this respect, upper portion 62 and lower portion 72 squeeze together tightly the rear damping plate 14 and parallel plates 24, 26 of front damping plate 12. The friction between the front damping plate 12 and rear damping plate 14 will hold the damping plates together as long as the skier applies a force to clutch housing 60 which is greater than the preloading force of bias means 44. Accordingly, when clutch 40 is engaged, front damping plate 12 and rear damping plate 14 will "lock" together to effectively form a single elongated plate, which will move in a longitudinal direction of the ski as ski 2 deflects. Coating 70 applied to the lower surface of central section 63 and to the upper surface of central section 73 lowers the friction between clutch housing 60 and parallel plates 24, 26, as plates 12 and 14 slide longitudinally. Accordingly, damping plates 12 and 14 are free to move longitudinally as the ski vibrates. Damping member 30, arranged at the front of ski 2, dissipates the vibration energy as damping plates 12, 14 move longitudinally (see FIG. 1).

It will be appreciated that damping member 30 may be located at any location along the ski between front and rear anchors 18, 20, including at clutch 40 itself, as will be described in connection with another embodiment of the present invention. Furthermore, the damping member may take the form of any material or mechanism that provides energy dissipation during deflection of the ski, including a viscoelastic material deformed in shear or compression, wet interleaved plates, dry interleaved plates, or a hydraulic piston and cylinder dashpot.

It should be noted that for the other embodiments of the present invention described below, the same element reference numbers are used where the elements remain unchanged from the embodiment shown in FIGS. 1–5.

Figure 6:
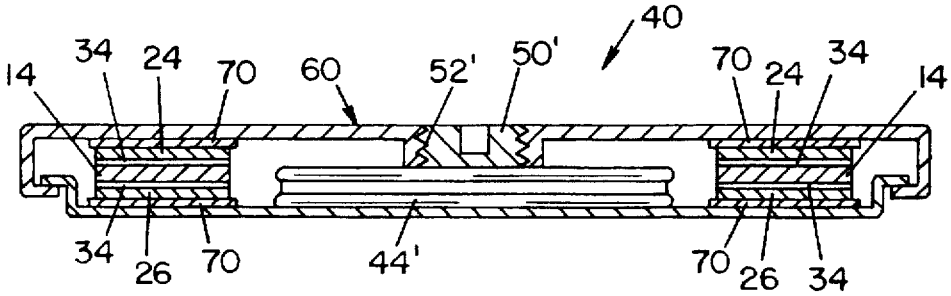
FIG. 6 is a sectional view of another embodiment of the present invention.

Referring now to FIG. 6, a cross-sectional view of another embodiment of the present invention is shown. In this embodiment, bias means 44' takes the form of pneumatic bellows. To accommodate the pneumatic bellows, adjuster 50' is comprised only of threaded portion 52'. In addition, this embodiment illustrates an alternative or additional damping member. In this respect, a damping elastomer 34 is applied to either the upper and lower surface of rear plate 14 or is applied to the lower surface of parallel plate 24 and the upper surface of parallel plate 26. Damping elastomer 34 may substitute for damping member 30, or it may be supplemental to damping member 30 to provide additional dissipation of vibration energy.

Figure 7:
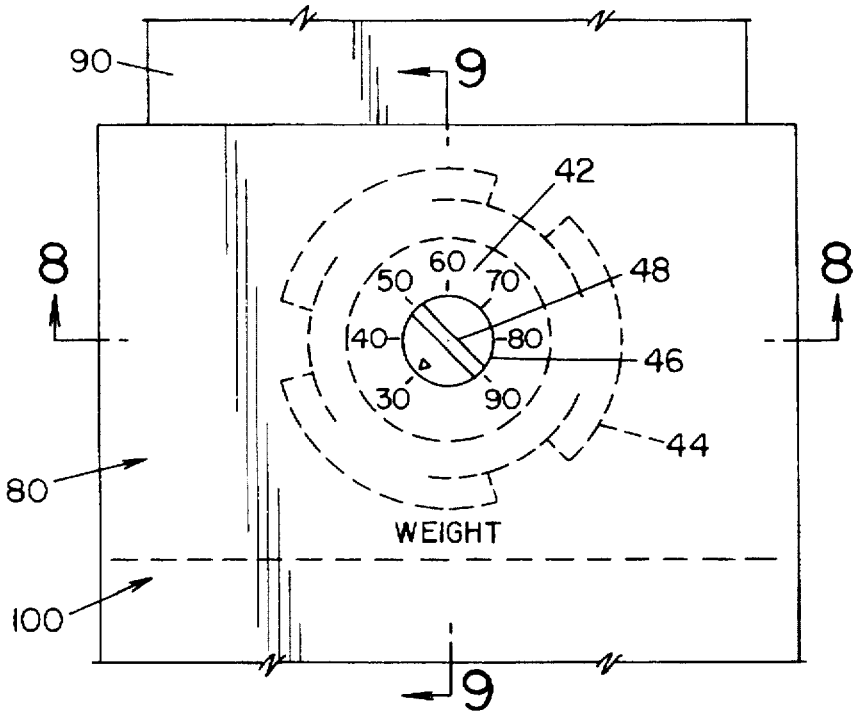
FIG. 7 is a top plan view of the clutch means according to still another embodiment of the present invention.
Figure 8:
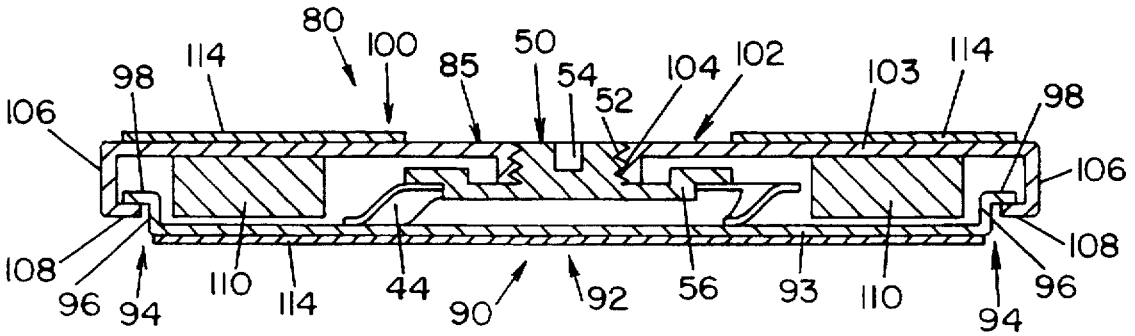
FIG. 8 is a sectional view taken along line 8—8 of FIG. 7.
Figure 9:
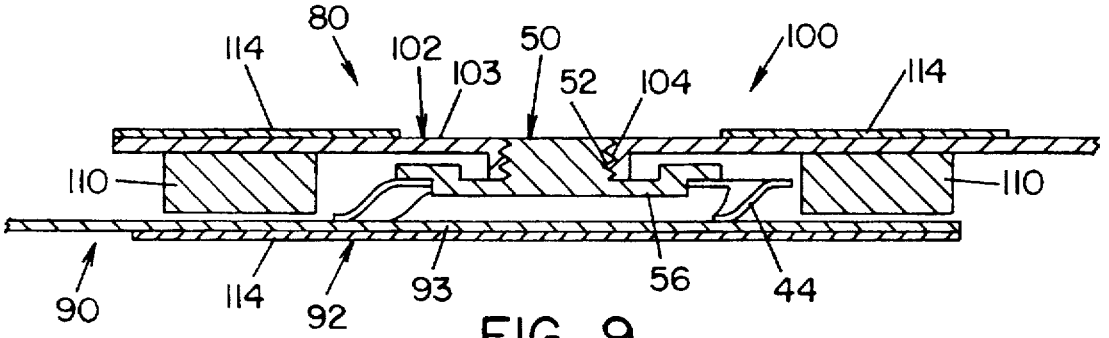
FIG. 9 is a sectional view taken along line 9—9 of FIG. 7.

Referring now to FIGS. 7–9 there is shown yet another embodiment of the present invention. In this embodiment, a clutch housing 85 of clutch 80 is an integral part of a front damping plate 90 and a rear damping plate 100. In this respect, one end of rear damping plate 100 meets and overlaps with one end of front damping plate 90. The overlapping portions of front damping plate 90 and rear damping plate 100 respectively form lower portion 92 and upper portion 102 of clutch housing 85.

The embodiment shown in FIGS. 7–9 is similar in many respects to the first embodiment shown in FIGS. 1–6. In this regard, lower portion 92 has a generally planar central section 93 and L-shaped shoulders 94. L-shaped shoulders 94 are comprised of a vertical section 96 and a horizontal section 98. Horizontal section 98 is operatively engageable with lip 108 of upper section 102.

Upper portion 102 is comprised of a central section 103 and side portions 106. Central section 103 includes a threaded opening 104 dimensioned to threadingly engage with threaded portion 52 of adjuster 50. Side portions 106 have lips 108 which are operatively engageable with lower portion 92 in the same manner as described with respect to the embodiment shown in FIGS. 1–6.

A high coefficient friction material 110 is attached to the lower surface of central section 103 along the portion of rear damping plate 100 that overlaps with lower portion 92 of front damping plate 90. Friction material 110 helps to keep upper portion 102 of rear damping plate 100 "locked" to lower portion 92 of the front damping plate 90 when clutch 80 is engaged, as will be explained in detail below.

A low-coefficient friction coating 114 (such as Teflon®) is applied to the upper surface of central section 103 to reduce friction between the sole of the ski boot and upper portion 102. Likewise, a coating 114 is applied to the lower surface of central section 93 to reduce friction between lower portion 92 and the top surface of the ski.

In the embodiment shown in FIGS. 7–9, clutch 80 is engaged by exerting a force on clutch housing 85 that exceeds the preloading force exerted by bias means 44. When the preloading force is overcome the lower surface of friction material 110 will engage with the upper surface of central section 93. Accordingly, upper portion 102 and lower portion 92 will "lock" together to effectively form a single elongated plate which is movable longitudinally as the ski deflects. Coating 114, which is applied to the lower surface of central section 93, reduces the friction between the surface of the ski (or a low friction material mounted thereon) and lower portion 92, as damping plates 90, 100 move longitudinally relative to ski 2. A damping member 30 is arranged at the front of the ski (as shown in FIG. 1) to dissipate vibration energy.

Figure 10:
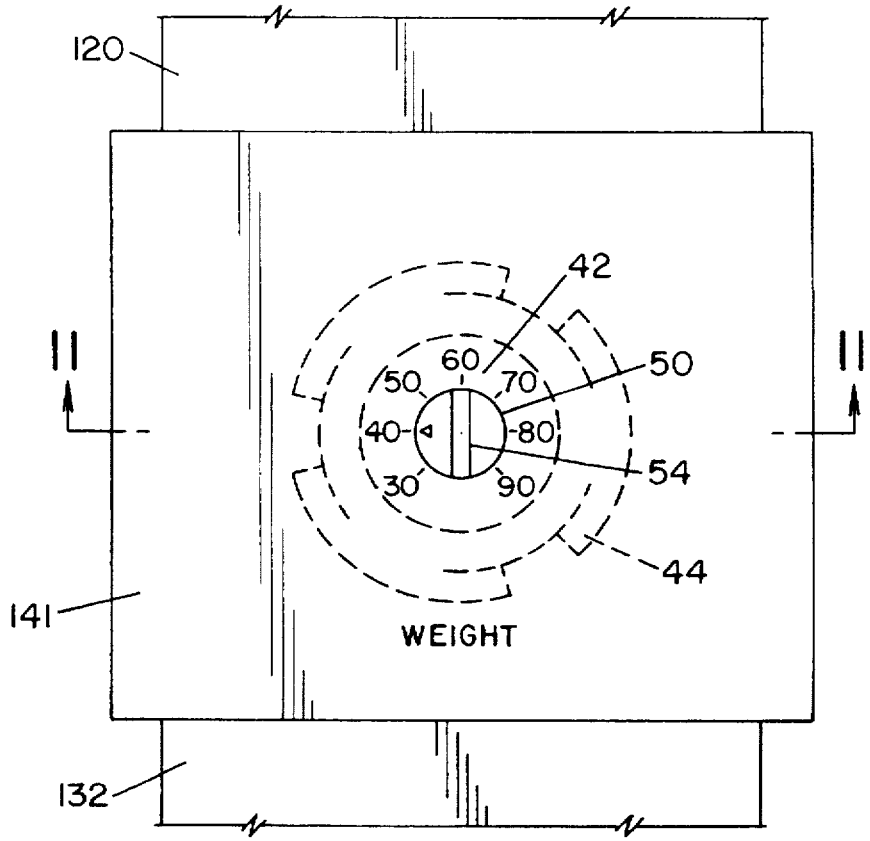
FIG. 10 is a top plan view of a clutch means according to yet another embodiment of the present invention.
Figure 11:
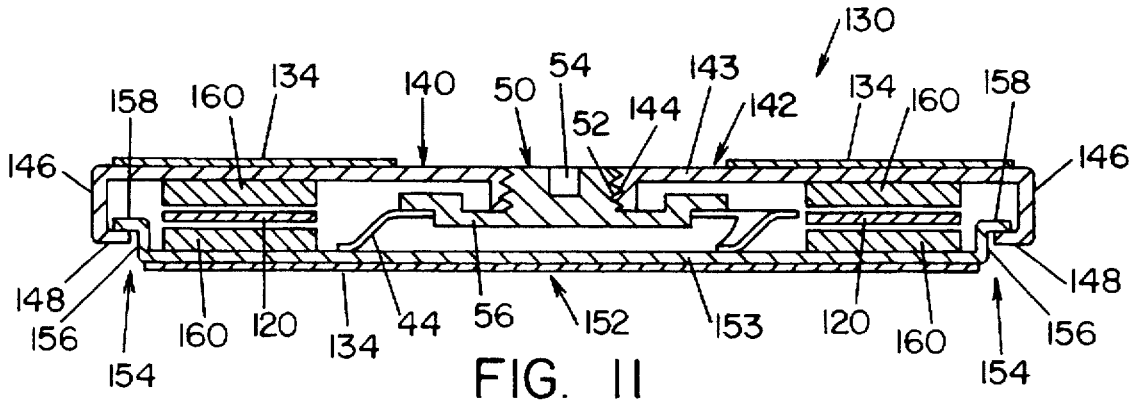
FIG. 11 is a sectional view along line 11—11 of FIG. 10.

Referring now to FIGS. 10 and 11, there is shown another embodiment of the present invention. In this embodiment, clutch housing 140 of a clutch 130 is integral with rear damping plate 141. The end of rear damping plate 141, which meets and overlaps with a front damping plate 120, is comprised of a pair of generally parallel plates having an upper portion 142 and a lower portion 152 of clutch housing 140, which define a slot for receiving front damping plate 120. Furthermore, a damping member 160 is arranged within clutch housing 140 to form an integral clutch/damper arrangement.

In many respects, the embodiment shown in FIGS. 10–11 is similar to the embodiment shown in FIGS. 1–6. In this regard, upper portion 142 is comprised of a central section 143 and side portions 146. Central section 143 includes a threaded opening 144 dimensioned to threadingly engage with threaded portion 52 of adjuster 50. Side portions 146 have lips 148, which are operatively engageable with lower portion 152.

Lower portion 152 has a generally planar central section 153 and L-shaped shoulders 154. L-shaped shoulders 154 are comprised of a vertical section 156 and a horizontal section 158. Horizontal section 158 is operatively engageable with lip 148 of upper section 142, in the same manner as described with respect to the embodiment shown in FIGS. 1–6.

A damping member 160 comprised of elastomer material is attached to the lower surface of upper portion 142 and to the upper surface of lower portion 152, or attached to both the upper and lower surfaces of the front damping plate 120. The length of damping member 160 may vary depending upon the amount of damping desired. In this regard, the amount of damping will increase with an increase in the length of damping member 160.

In addition, a low-coefficient friction coating 134 (e.g., Teflon®) is applied to the upper surface of upper portion 142 and to the lower surface of lower portion 152. Coating 134 provides a low friction surface between upper portion 142 of clutch housing 140 and a ski boot, and lower portion 152 of clutch housing 140 and the upper surface of the ski (or a low friction material mounted thereon). As with the embodiment shown in FIGS. 7–8, coating 134 allows rear damping plate 141 to move longitudinally when ski 2 deflects. It should be noted that in this embodiment, both the front end of front damping plate 120 and the rear end of rear damping plate 141 are fixed to the ski. The rear end of front damping plate 120 and the front end of rear damping plate 141 are free overlapping ends.

As in the embodiments discussed above, clutch 130 is engaged by exceeding the preloading force of bias means 44. When the preloading force of bias means 44 is overcome, damping member 160 will become engaged between front damping plate 120 and rear damping plate 141. Accordingly, rear damping plate 141 and front damping plate 120 will "lock" together to effectively form a single elongated plate, with damping member 160 arranged between the damping plates. It will be appreciated that damping member 160 provides shear damping as ski 2 deflects.

Referring now to FIGS. 12–15, there is shown another embodiment of the present invention. In this embodiment, a damping and stiffening member 30' is activated by a clutch, as illustrated in the schematic shown in FIG. 13. This embodiment also includes a modified clutch 170, rear damping plate 180, and front damping plate 175.

The rear end of rear damping plate 180 is fixed to ski 2 using a fastener or rear anchor 20. Rear damping plate 180 extends forward through a slot in heel piece 8, under ski boot 4 and toe piece 6. Toe piece 6 is mounted to the upper surface of rear damping plate 180. A fastener 19 arranged in front of toe piece 6 fixes rear damping plate 180 in the transverse direction and limits movement in the vertical direction. Furthermore, an elongated slot is provided in rear damping plate 180 for receiving front damping plate 175. The slot allows rear damping plate 180 to move in the longitudinal direction as ski 2 flexes. The entire length of rear damping plate 180 forms a clutch housing 172 for clutch 170. In this respect, rear damping plate 180 is formed of a pair of generally parallel plates defining a slot in which front damping plate 175 extends.

Front damping plate 175 is attached to the combined damping and stiffening system 30' and extends rearward through the elongated slot in rear damping plate 180 to a position approximately beneath the toe portion of ski boot 4.

Figure 14:
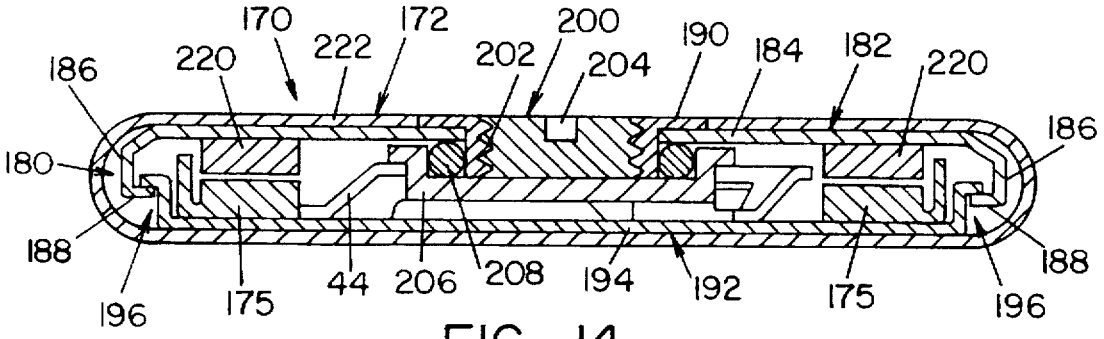
FIGS. 14 and 15 are sectional views of the clutch means according to the embodiment shown in FIG. 12.
Figure 15:
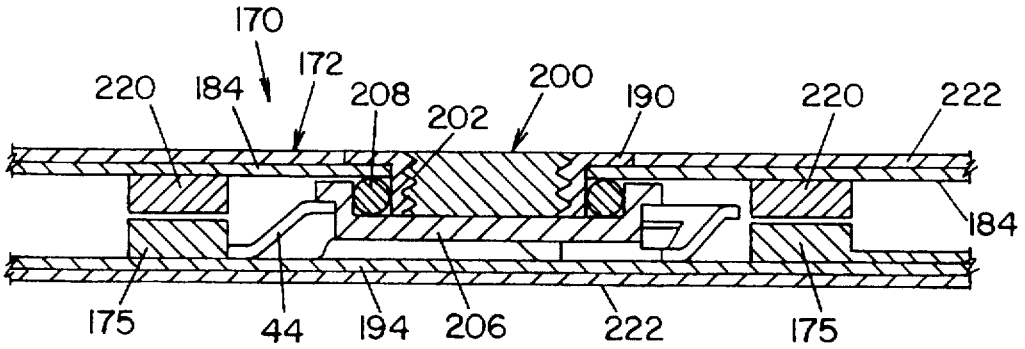

As indicated above and referring to FIG. 14, rear damping plate 180 is comprised of a pair of generally parallel plates. The upper parallel plate forms an upper portion 182 of clutch housing 172, while the lower plate forms a lower portion 192 of clutch housing 172. Upper portion 182 is comprised of a generally flat central section 184 and a pair of side portions 186. A threaded opening 190 is formed in central section 184 for receiving an adjuster 200, which will be described below. A lip 188 is formed along the lower edge of side portions 186. Lip 188 is a generally horizontal inward extending portion. The upper surface of lip 188 is operatively engageable with lower portion 192, as will be explained below.

Lower portion 192 is comprised of a generally planar central section 194 and L-shaped shoulders 196. The horizontal portion of the L-shaped shoulder 196 is operatively engageable with lip 188. In this respect, when upper portion 182 and lower portion 192 are biased apart, the horizontal section of L-shaped shoulder 196 engages with lip 188.

A high coefficient friction material 220 is arranged on the lower surface of central section 184 along the portion of rear damping plate 180 that overlaps with front damping plate 175. Friction material 220 helps to keep rear damping plate 180 "locked" to front damping plate 175 when clutch 170 is engaged, as will be explained in detail below.

A waterproof covering 222 is arranged around the outside of rear damping plate 180 in order to protect rear damping plate 180 from outdoor elements, such as snow, ice and water.

Adjuster 200 is generally comprised of a threaded portion 202 and a ring-like engaging member 206. A slot 204 is formed at the top of threaded portion 202 to allow for rotation of adjuster 200. Rotation of threaded portion 202 so that it moves downward causes engaging member 206 to move downward as well. Downward movement of engaging member 206 increases the preloading force exerted by bias means 44 on clutch housing 172. Likewise, rotating threaded portion 202 so that it moves upward decreases the preloading force exerted by bias means 44 on clutch housing 172. O-ring 208 may be arranged between threaded opening 190 and engaging member 206 in order to protect clutch 170 from outdoor elements, such as snow, ice and water.

In the embodiment shown in FIGS. 12–15, clutch 170 is engaged by exerting a force on clutch housing 172 that exceeds a preloading force exerted by bias means 44. When the preloading force is overcome, the lower surface of friction material 220 will engage with the upper surface of front damping plate 175. Accordingly, front damping plate 175 and rear damping plate 180 will "lock" together to effectively form a single elongated plate which is movable longitudinally as the ski deflects. It should be appreciated that front damping plate 175 and friction material 220 may have grooved surfaces 176 and 221 respectively, where they engage each other, thus forming a "dog clutch," as shown in FIG. 18A. A "dog clutch" can sustain greater forces than a flat surface.

Figure 12:
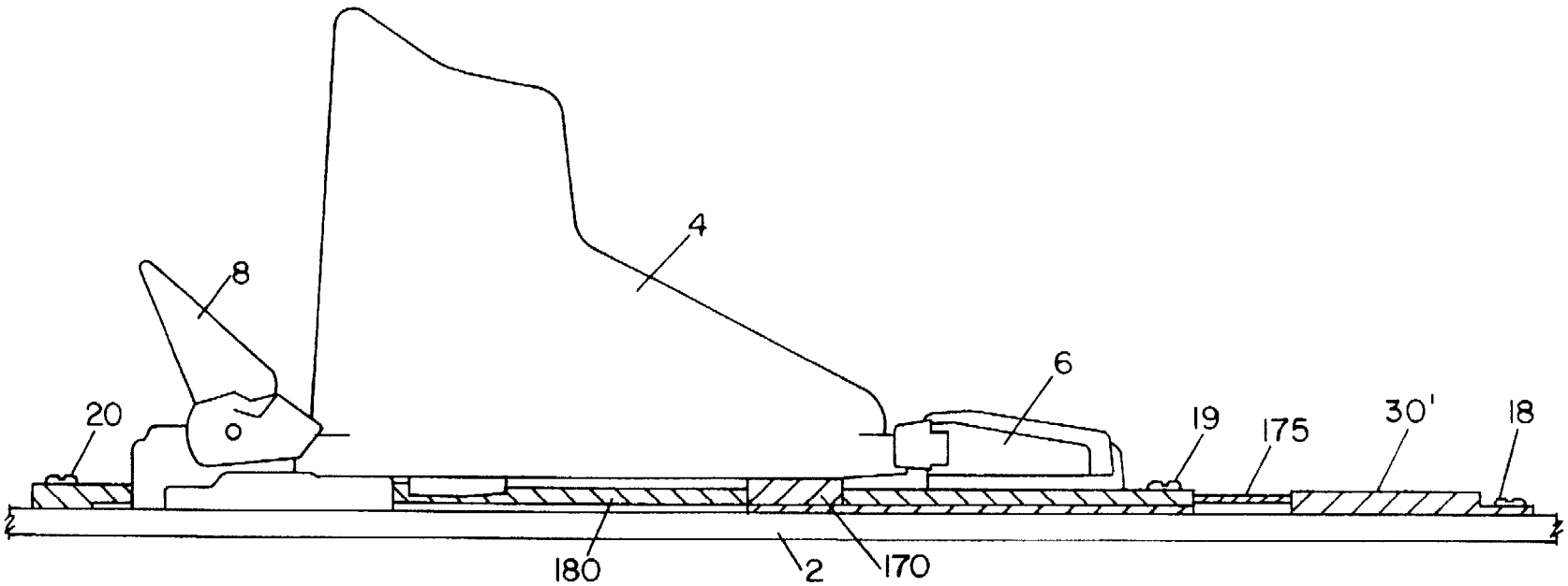
FIG. 12 is a side plan view of another embodiment of the present invention having both a damping member for damping the ski and a stiffening member for stiffening the ski.
Figure 13:
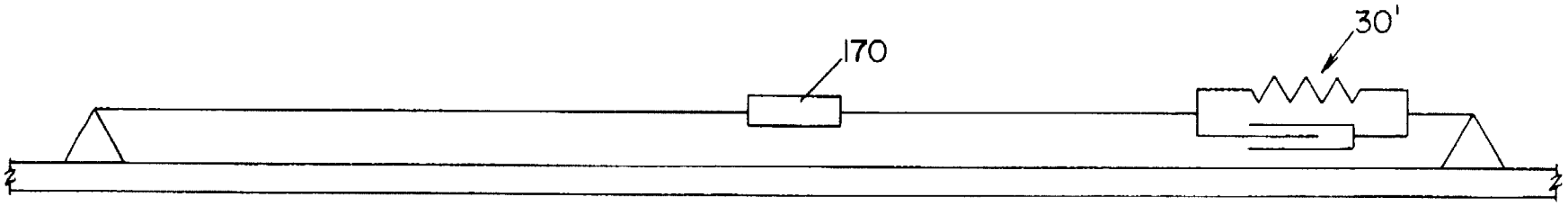
FIG. 13 is a schematic view of the embodiment shown in FIG. 12.

A combined damping and stiffening member 30' is arranged at the front of the ski (as shown in FIGS. 12 and 13) to both dissipate vibration energy and to stiffen the ski. It should be understood that both the damping member and the stiffening member may be adjustable. Accordingly, the amount of damping and stiffening provided during engagement may be selectively varied.

It should be appreciated that the stiffening member primarily stiffens the ski, while the damping member provides damping. For example, the stiffening member may take the form of a coil spring. Alternatively, a single element which provides both vibration damping and ski stiffening may be substituted for separate damping and stiffening members. For instance, a urethane compression spring comprised of a bulging tube of urethane rubber could be used. A urethane compression spring will dampen and stiffen when a force acts on the compression spring, causing the tube walls to bulge outward.

Furthermore, it should be understood that a stiffening member (e.g., a spring) could be used alone, without a damping member. In this case, the ski will only be stiffened when the clutch is engaged.

Figure 18:
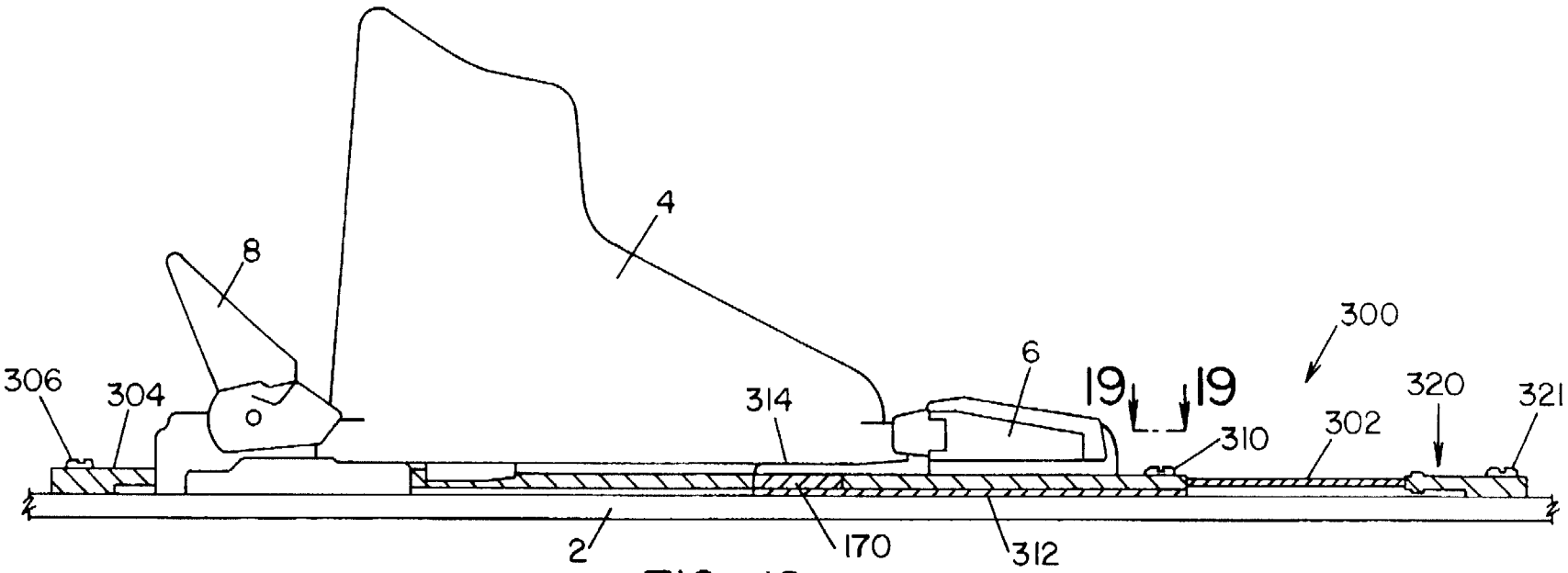
FIG. 18 is a side view of another embodiment of the invention showing a boot mounted in a binding with a clutched damper-spring mechanism.
Figure 18A:
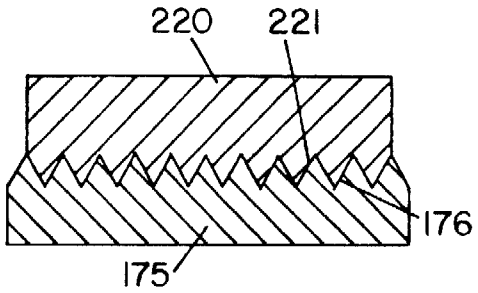
FIG. 18A is an exploded, partial side view of a dog clutch useable in the invention, as in FIG. 18.
Figure 19:
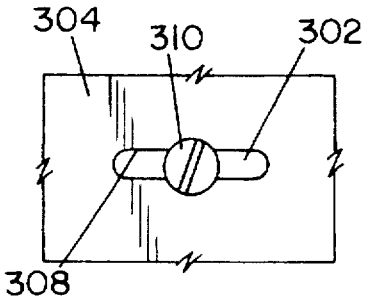
FIG. 19 is a partial top view shown at the arrows 19—19 in FIG. 18.

FIG. 18 shows another embodiment of the invention for automatically controlling both the vibrations of the ski and for controlling the stiffness of the ski. A vibration and stiffness controlling system 300 mounted on ski 2 having a toe piece 6 and a heel piece 8 for securing the boot to the ski. Vibration and stiffness controlling system 300 includes a front damping plate 302 and a rear damping plate 304. Rear damping plate 304 is attached to ski 2 by a fastener or anchor 306, and extends forwardly through an opening in heel piece 8 and under toe piece 6. A longitudinal slot 308 shown in FIG. 19 extends in the forward portion of rear damping plate 304. The rearward portion of front damper plate 302, and a fastener 310 extends through slot 308 into ski 2. Fastener 310 prevents the vertical and transverse movement of damper plates 302 and 304, but is loose enough to allow longitudinal movement when the ski flexes. A low friction plate 312 is attached to ski 2 beneath toe piece 6, and a clutch system such as clutch system 170 shown in FIGS. 12–15, is slidingly mounted on plate 312. Toe piece 6 is shown as being of the type having an anti-friction device having a movable toe plate 314. Toe plate 314 is rotatable about an arc having a center in the forward portion of toe piece 6, so that toe plate 314 moves transversely across ski 2 as it is moved by the toe portion of the ski boot.

Figure 20:
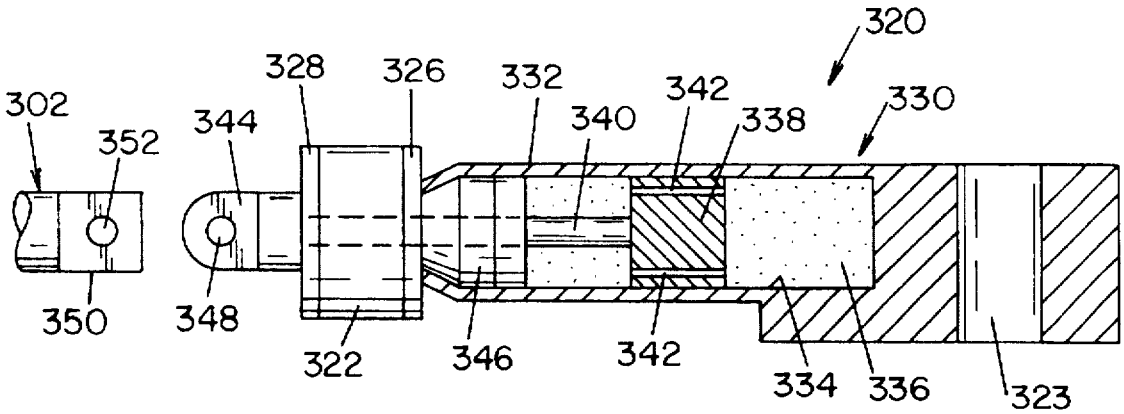
FIG. 20 is a detailed, cutaway side view of an hydraulic damper with stiffening spring of FIG. 18.

Vibration and stiffness controlling system 300 also includes the spring and damper assembly 320. Referring to FIG. 20, assembly 320 is shown as comprising a urethane spring 322 having forwardly and rearwardly disposed inflexible end members 326 and 328, and a hydraulic damper 330. Assembly 320 is attachable to ski 2 by a fastener 321 ending through hole 323 into ski 2.

Hydraulic damper 330 comprises a sealed housing 332 having a cylinder 334 filled with a hydraulic fluid 336, such as silicone oil. Cylinder 334 is cylindrical, and includes inside it a cylindrical piston 338 connected to a damper or piston rod 340. Piston 338 has fluid flow ports 342 of sufficient size and number to enable the movement of piston 338 according to the axial force on damper rod 340. A set of guides 346 assures the proper axial path of movement of damper rod 340. Rod 340 extends through a longitudinal axial opening in spring 322, and terminates in a flattened rear end portion 344 having a hole 348. Front plate member 302 terminates in a yoke 350 at its front end having holes 352 aligned in both portions of the yoke. Holes 352 are aligned with hole 348, and a fastener connects plate member 302 to damper rod 340.

Hydraulic damper 330 is a double-acting hydraulic damper, dampening vibrations as the piston moves forward and backward in cylinder 332.

Urethane spring 322 is preferably an adiprene urethane spring. Adiprene urethane has some internal dampening, and it stiffens little at cold temperatures. The stiffness is constant down to −18° C. It thereafter stiffens 1% per 50° C. It does not corrode and is inexpensive.

Spring 322 is positioned on damper rod 340 and functions as a spring in parallel with damper 330. An appropriate adiprene urethane spring for spring 322 is a 95 durometer urethane spring measuring 19 mm OD (outer diameter), 5.8 mm ID (inner diameter), and 17 mm L (length) with a rate of 800N (newtons) per mm, which can sustain a maximum load of 2000N.

When ski 2 of FIG. 18 flexes with the central portion of ski 2 depressing more than the ends of ski 2, rod 340 compresses urethane spring 322 by compressing washer 328 towards washer 326. This spring stiffens the ski. Rod 340 further moves axially through guides 346 and moves piston 338 to the right. As piston 328 moves, the hydraulic fluid flows through ports 342. When ski 2 counterflexes, the compression of spring 322 is decreased, and piston 338 is moved rearwardly as rod 340 moves rearwardly.

Figure 21:
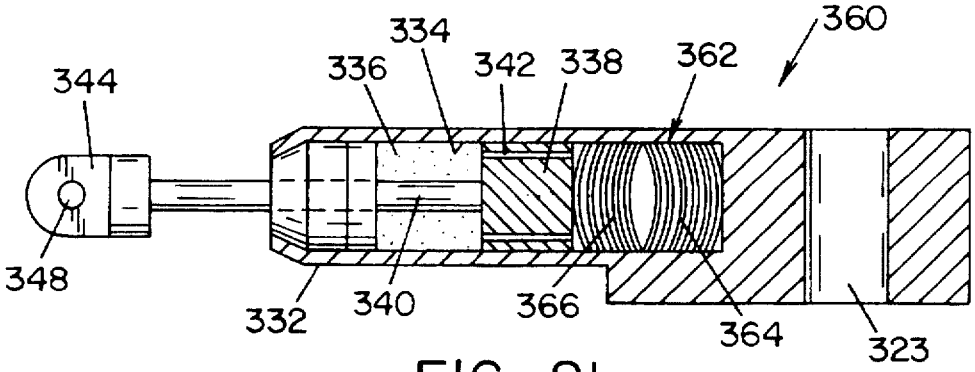
FIG. 21 is a detailed, cutaway side view of an alternate hydraulic damper with stiffening spring of FIG. 18.

A variation of spring and damper assembly 320 is shown by the modified spring and damper assembly 360 in FIG. 21. Parts in FIG. 21 corresponding to those in FIG. 20 are given the same numbers as those in FIG. 20. However, urethane spring 322 is dispensed with, and the spring is instead disposed in cylinder 334. Accordingly, a spring 362 is located inside cylinder 334 forwardly of piston 338. Preferably, spring 362 is composed of a series of stacked Belleville spring washers. The forward washers 364 are stacked six in parallel, and the rearward washers 366 are stacked five in parallel. Washers 364 are stacked in series with washers 366. Belleville washers are good for sustaining high loads in small spaces, and the stiffness of the spring depends on the number of washers in a stack.

Figure 22:
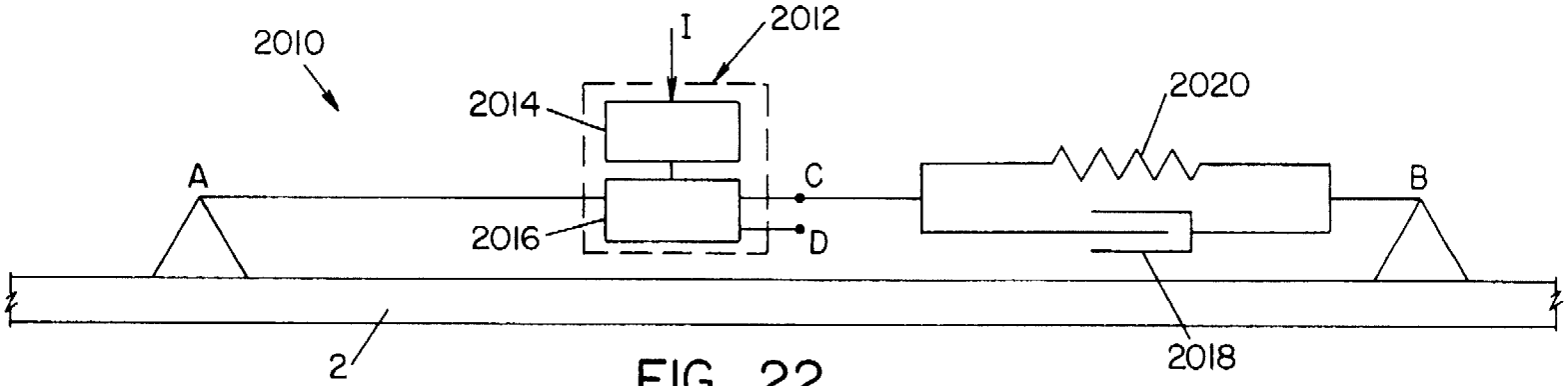
FIG. 22 is a schematic view of a damping/stiffening system according to another embodiment of the invention.
Figure 23:
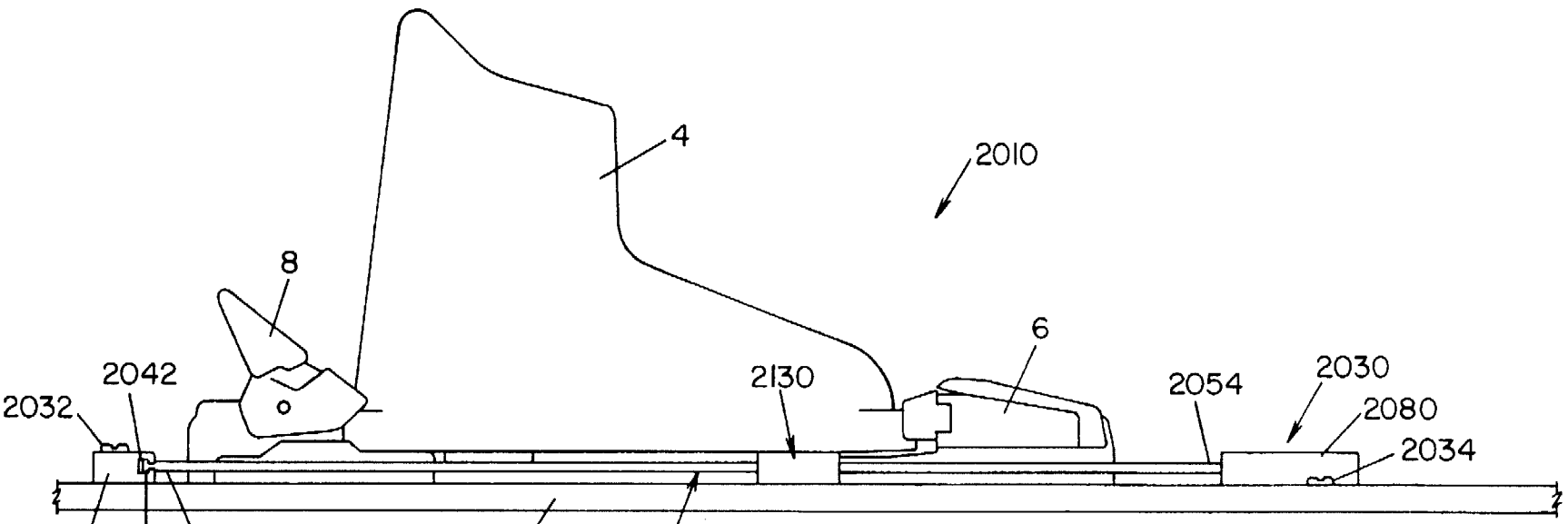
FIG. 23 is a side view of the damping/stiffening system shown as a schematic in FIG. 22.
Figure 24:
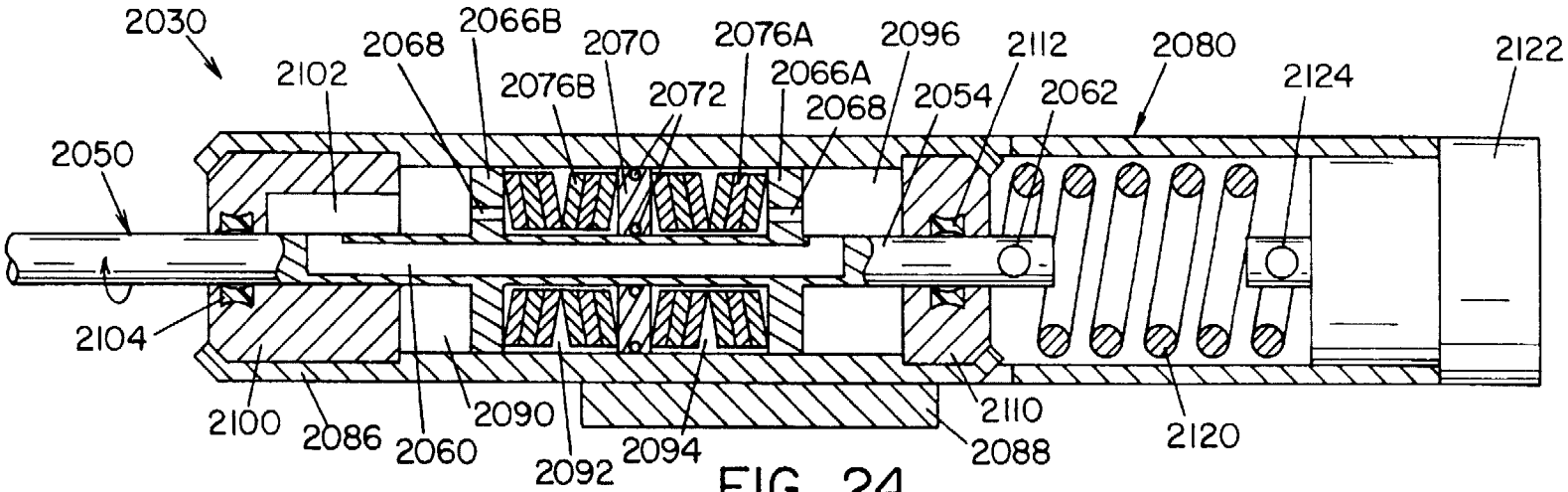
FIG. 24 is a detailed cutaway side view of a hydraulic damping/stiffening member of the damping/stiffening system shown in FIG. 23.

Referring now to FIGS. 22–24, there is shown another embodiment of the present invention. In this embodiment, an automatic switch means engages and disengages a hydraulic damper and spring assembly 2030. It should be appreciated that this embodiment of the present invention has advantages over the clutch-activated systems described above. In this respect, it is often difficult for a clutch to carry large forces, such as those encountered during a turn. Furthermore, any water collecting on the clutch plates may cause slippage of the plates, thus impairing their effectiveness to engage and disengage a damping and/or stiffening member.

A schematic of a damping/stiffening system 2010, according to this embodiment of the present invention, is shown in FIG. 22. A ski 2 is illustrated having a damping/stiffening system 2010 connected to the top surface thereof. Damping/stiffening system 2010 includes a damping means 2018, a stiffening means 2020 and a switch means 2012. Damping means 2018 and stiffening means 2020 act in parallel with each other and in series with switch means 2012, which engages and disengages damping means 2018 and stiffening means 2020.

Damping means 2018 alternatively has an active condition for damping vibrations and an inactive condition for lessening the dampening of ski 2. Likewise, stiffening means 2020 alternatively has an active condition for stiffening ski 2 against bending, and an inactive condition for lessening stiffening of ski 2. Lessening the stiffening of ski 2 can either not stiffen ski 2 at all or can lessen the stiffening of ski 2 below the stiffening which occurs when stiffening means 2020 is in the active condition.

Damping means 2018 and stiffening means 2020 are operatively connected to switch means 2012. Switch means 2012 includes a threshold means 2014 and a switching member 2016. Threshold means 2014 receives an input I. Input I could, for example, be an input force. Switching member 2016 has an engaging condition and a disengaging condition. When switching member 2016 is in its engaging condition, it puts damping means 2018 and stiffening means 2020 in their active conditions. The engaging condition is shown with symbol C. When switching member 2016 is in its disengaging condition, it puts damping means 2018 and stiffening means 2020 in their inactive conditions. The disengaging condition is shown with symbol D.

When input I meets some threshold value, threshold means 2014 puts switching member 2016 in one of its engaging or disengaging conditions. When input I is below (or depending on its construction, above) the threshold value, switching member 2016 assumes the other of the disengaging or engaging condition. It should be appreciated that input I may be a minimum force applied to switching member 2016, depending upon construction. When input I meets some threshold value, threshold means 2014 allows switching member 2016 to be in one of its engaging or disengaging conditions.

FIG. 23 shows a damping/stiffening system 2010 mounted to a ski 2, along with a ski binding toe piece 6 and ski binding heel piece 8. Toe piece 6 and heel piece 8 secure a ski boot 4 to ski 2.

Damping/stiffening system 2010 is generally comprised of a hydraulic damper and spring assembly 2030 and a switching means 2130. Damper and spring assembly 2030 is generally comprised of a longitudinally extending rod member 2050, a cylinder member 2080 and bias means 2076A and 2076B, as shown in FIG. 24.

Figure 26:
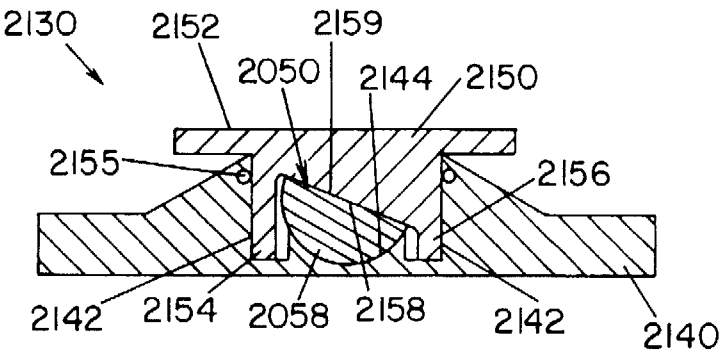
FIG. 26 is a sectional end view of the damping/stiffening member actuator in an engaged position.
Figure 25:
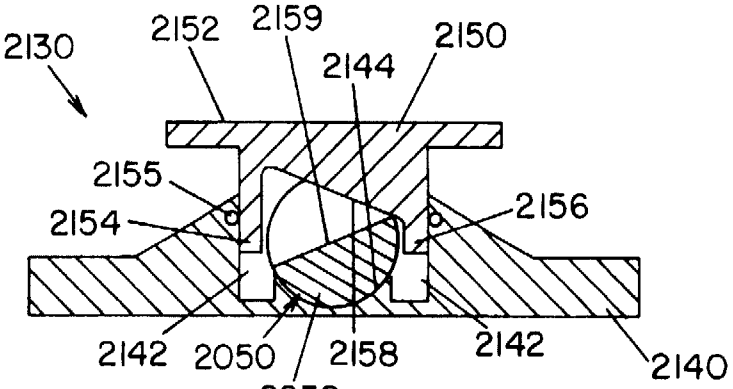
FIG. 25 is a sectional end view of the damping/stiffening member actuator in a disengaged position.

Rod member 2050 has a fixed end 2052 and a free end 2054, and extends generally from behind heel piece 8 to in front of toe piece 6, as seen in FIG. 23. Rod member 2050 includes a locking portion 2056 located at fixed end 2052, and an engagement portion 2058 centrally located between fixed end 2052 and free end 2054 (FIGS. 25 and 26). Locking portion 2056 engages with an anchor member 2040, which is fixed to ski 2 by a fastener 2032. Anchor member 2040 includes a recess 2042 dimensioned to receive locking portion 2056 (FIG. 23). Locking portion 2056 engages with anchor member 2040 such that fixed end 2052 is fixed relative to ski 2 in the longitudinal and transverse directions of ski 2. However, it should be noted that rod member 2050 can rotate about its longitudinal axis, as will be described in detail below. Engagement portion 2058 of rod member 2050 is generally located at a position beneath the toe portion of ski boot 4. Engagement portion 2058 has a generally semi-circular shape, including a planar surface 2059 (FIGS. 25 and 26). Engagement portion 2058 forms a part of switch means 2130, which is described in detail below.

As indicated above, rod member 2050 generally extends from behind heel piece 8 to in front of toe piece 6. In this respect, rod member 2050 extends through a slot in heel piece 8, through switch means 2130, and through a slot in toe piece 6 (FIG. 23). Free end 2054 of rod member 2050 joins with cylinder member 2080 in front of toe piece 6 to form a hydraulic damper and spring assembly 2030, as will be described in detail below.

Free end 2054 will now be described with reference to FIG. 24. Free end 2054 of rod member 2050 is generally comprised of a U-shaped channel 2060, front fixed piston 2066A, rear fixed piston 2066B and floating piston 2070. U-shaped channel 2060 transmits fluid from behind rear fixed piston 2066B to in front of front fixed piston 2066A, and vice versa. U-shaped channel 2060 is rotatable between an open position and a closed position, to provide a rotary valve. When hydraulic fluid is allowed to pass through channel 2060 (i.e., open position), damper and spring assembly 2030 is in a disengaged condition. In contrast, when hydraulic fluid is prevented from passing through channel 2060 (i.e., closed position), damper and spring assembly 2030 is in an engaged condition. Transmission of hydraulic fluid through U-shaped channel 2060 will be discussed in further detail below.

Fixed pistons 2066A, 2066B are generally disk-shaped and have an orifice 2068 formed therein. Orifices 2068 allow hydraulic fluid to pass through pistons 2066A, 2066B in order to provide damping, as will be discussed below. Floating piston 2070 is arranged along free end 2054 at a position approximately equidistant between fixed pistons 2066A and 2066B. Floating piston 2070 is generally disk-shaped like fixed pistons 2066A and 2066B, and includes O-ring seals 2072. O-ring seals 2072 prevent hydraulic fluid from passing by floating piston 2070.

A hole 2062 is formed at the distal end of free end 2054. Hole 2062 is dimensioned to receive a spring for applying a torque to rod member 2050, as will be discussed below.

It should be appreciated that the hydraulic fluid is preferably silicone due to its appropriate low temperature viscosity.

Damper and spring assembly 2030 provides stiffening to ski 2 through bias means 2076A and 2076B. Bias means 2076B is arranged between floating piston 2070 and rear fixed piston 2066B. Similarly, bias means 2076A is arranged between floating piston 2070 and front fixed piston 2066A. Bias means 2076A and 2076B preferably take the form of stiffening springs, such as the sets of stacked belleville spring washer springs shown in FIG. 24. As shown in FIG. 24, bias means 2076A and 2076B is comprised of six belleville spring washers. Three rearward-facing spring washers are stacked against three forward-facing spring washers. It should be appreciated that other types of bias means, including curved spring washers and compression springs are also suitable.

Cylinder member 2080 is generally comprised of a housing 2086, a mounting plate 2088, a first end guide 2100, and a second end guide 2110. Mounting plate 2088 provides a surface for attaching housing 2086 to ski 2, using laterally positioned fasteners 2034 (FIG. 23).

Housing 2086 has an opening at one end thereof for receiving free end 2054 of rod member 2050. End guides 2100 and 2110 support rod member 2050 inside housing 2086. First end guide 2100 is fixed within an annular recess in housing 2086, and includes a rubber seal 2104 and a cavity 2102. Seal 2104 prevents leakage of hydraulic fluid from cylinder member 2080 and provides a bearing surface for rod member 2050. Cavity 2102 provides a passageway for hydraulic fluid to enter and exit channel 2060 of rod member 2050. Second end guide 2110 is also fixed within an annular recess in housing 2086. Second end guide 2110 supports the distal end of free end 2054, and includes a rubber seal 2112 to prevent the leakage of hydraulic fluid from cylinder member 2080 and to provide a bearing surface for rod member 2050.

It should be appreciated that first end guide 2100 and rear fixed piston 2066B define a first chamber 2090; rear fixed piston 2066B and floating piston 2070 define a second chamber 2092; floating piston 2070 and front fixed piston 2066A define a third chamber 2094; and front fixed piston 2066A and second end guide 2110 define a fourth chamber 2096. Cavity 2102 provides a passageway for fluid to pass between channel 2060 and first chamber 2090.

Torsion spring 2120 and force adjustment member 2122 are located in front of second end guide 2110 (FIG. 24). Adjustment member 2122 is arranged through an opening formed in housing 2086, and includes a hole 2124 dimensioned to receive one end of spring 2120. The other end of spring 2120 is received by hole 2062 of rod member 2050 mentioned above. Spring 2120 provides a threshold means for switch means 2130 by applying a torsional force to rod member 2050. The amount of torsional "preload" force applied to rod member 2050 is determined by rotating adjustment member 2122. The amount of force applied to rod member 2050 will determine the amount of torsional force which must be provided to rod member 2050 before damper and spring assembly 2030 is engaged (i.e., threshold force). Details of this operation are provided below. It should be appreciated that, in general, the preload force will be equal to approximately one-half the skier's weight.

With reference to FIGS. 25 and 26, switch means 2130 will now be described. FIG. 25 shows switch means 2130 in an "OFF" or disengaged position, while FIG. 26 shows switch means 2130 in an "ON" or engaged position. Switch means 2130 is generally comprised of a base member 2140 and a rotator member 2150. Base member 2140 includes a pair of vertical slots 2142 and a concave groove 2144. Concave groove 2144 is dimensioned to receive engagement portion 2058 of rod member 2050.

Rotator member 2150 includes a support surface 2152, legs 2154 and 2156, O-ring 2155, and a slanted engagement surface 2158. Support surface 2152 contacts with the sole of ski boot 4, preferably at the toe end of ski boot 4. Legs 2154, 2156 are dimensioned to be received by slots 2142. O-ring 2155 provides a seal to prevent water from getting into slots 2142. Slanted engagement surface 2158 engages with planar surface 2059 of engagement portion 2058 to rotate rod member 2050. In the embodiment shown, rod member 2050 rotates approximately 45°. It should be noted that a stopper (not shown) prevents rotator member 2150 from becoming disengaged from slots 2142.

Operation of damping/stiffening system 2010 will now be described with particular reference to FIGS. 24–26. As ski 2 flexes, free end 2054 of rod member 2050 will move relative to ski 2. Free end 2054 interacts with the hydraulic fluid and bias means 2076A, 2076B to damp and stiffen ski 2, when damping and stiffening assembly 2030 is engaged. When damping and stiffening assembly 2030 is disengaged, movement of free end 2054 will not damp or stiffen ski 2.

Damper and spring assembly 2030 will be in a disengaged condition when channel 2060 is in the open position, thus allowing hydraulic fluid to freely flow through channel 2060, as shown in FIG. 24. In this regard, channel 2060 communicates simultaneously with cavity 2102 (and therethrough to first chamber 2090) and with fourth chamber 2096. Accordingly, hydraulic fluid is free to transfer between first chamber 2090 and fourth chamber 2096. For instance, when rod member 2050 moves forward, first chamber 2090 will increase in volume, while fourth chamber 2096 will decrease in volume. As a result, fluid will transfer from fourth chamber 2096 into first chamber 2090 via channel 2060. Since the fluid will travel through a path of least resistance, only a negligible amount of fluid will pass through orifice 2068 of fixed piston 2066A. Accordingly, no significant damping due to hydraulic fluid movement will occur. Furthermore, since floating piston 2070 will be free to move, bias means 2076B in second chamber 2092 will not be compressed. Accordingly, bias means 2076B will not act to stiffen ski 2 as it bends.

Similarly, when rod member 2050 moves rearward, first chamber 2090 will decrease in volume, while fourth chamber 2096 will increase in volume. As a result, hydraulic fluid will transfer from first chamber 2090 to fourth chamber 2096 via channel 2060. Only a negligible amount of fluid will travel through orifice 2068 of fixed piston 2066B, since the fluid will travel through a path of least resistance. Accordingly, no significant damping due to hydraulic fluid movement will occur. Furthermore, since floating piston 2070 remains free to move, bias means 2076A in chamber 2094 will not be compressed. Accordingly, bias means 2076A does not act to increase the stiffness of ski 2.

Damper and spring assembly 2030 is in a disengaged condition when switch means 2130 is in the position shown in FIG. 25. In the disengaged position, rotator member 2150 is in an upward position and slanted engagement surface 2158 is not in contact with the planar surface 2059 of engagement portion 2058.

To put damper and spring assembly 2030 in an engaged condition, switch means 2130 must be moved to the engaged position. To do so, the skier must apply a force to switch means 2130 (and consequently a torsional force to rod member 2050), which is greater than the preload force exerted by torsion spring 2120. In particular, the skier must exert a downward force on support surface 2152 which provides a torque on rod member 2050 great enough to overcome the preload force of torsion spring 2120, thus rotating rod member 2050 to the position shown in FIG. 26. More specifically, rod member 2050 must rotate such that planar surface 2059 of engagement portion 2058 engages with slanted engagement surface 2158 of rotator member 2150.

When damper and spring assembly 2030 is in an engaged condition, channel 2060 is in the closed position, and thus does not communicate with either cavity 2102, which links to first chamber 2090. Accordingly, fluid cannot flow therebetween. Consequently, floating piston 2070 becomes hydraulically locked in place. When rod member 2050 moves forward, while damper and spring assembly 2030 is engaged, both damping and stiffening will occur. In this respect, bias means 2076B in second chamber 2092 will be compressed, as rear fixed piston 2066B moves toward floating piston 2070 (which is locked in position). This will increase the stiffness of ski 2. Furthermore, front fixed piston 2066A will move towards second end guide 2110. Since hydraulic fluid is unable to flow through channel 2060, it will be forced through orifice 2068 of fixed piston 2066A. The forced flow of fluid through orifice 2068 will damp ski 2. Similarly, as fixed piston 2066B moves towards floating piston 2070 (which is locked in place) fluid will be forced through orifice 2068 of fixed piston 2066B, thus providing additional damping.

When rod member 2050 moves rearward while damper and spring assembly 2030 is engaged, both damping and stiffening will occur in a similar manner as described above. In this respect, bias means 2076A in third chamber 2094 will be compressed, as front fixed piston 2066A moves toward floating piston 2070 (which is in a locked position). This will increase the stiffness of ski 2. Furthermore, rear fixed piston 2066B will move toward first end guide 2100. Since fluid is unable to flow through channel 2060 of rod member 2050, it will be forced through orifice 2068 of fixed piston 2066B. The forced flow of fluid through orifice 2068 will damp ski 2. Similarly, as fixed piston 2066A moves towards floating piston 2070 (which is locked in place) fluid will be forced through orifice 2068 of fixed piston 2066A, thus providing additional damping.

It should be appreciated that when a skier is gliding in a straight line, his or her weight will be divided nearly equal on the two skis and thus switch means 2150 will be in a disengaged position as shown in FIG. 25. As a consequence, torsion spring 2120 will provide a preload force on such rod member 2050, such that channel 2060 is able to carry fluid between first chamber 2090 and fourth chamber 2096. When a skier initiates a turn, the skier unloads the skis. Accordingly, switch means 2150 will remain in the disengaged position shown in FIG. 25. As a result, channel 2060 remains in an open position, transferring fluid between first chamber 2090 and fourth chamber 2096. Once into a turn, the skier's weight is transferred to the downhill ski and forward (from the heel to the toe). As a result, switch means 2130 located under the skier's boot toe receives a force sufficient to overcome the preload force of torsion spring 2120 and rotate rod member 2050 to the position shown in FIG. 26. In particular, rotator 2150 is forced downward, which in turn, causes rod member 2050 to produce a torque that is sufficient to overcome the preload force of torsion spring 2120. Rotation of rod member 2050 causes channel 2060 to move to the closed position, wherein channel 2060 does not transfer fluid between first chamber 2090 and fourth chamber 2096. Consequently, floating piston 2070 becomes locked in place. Therefore, movement of rod member 2050 (forward and rearward) with respect to floating piston 2070 will compress bias means 2076A, 2076B thus increasing the stiffness of ski 2. In addition, hydraulic fluid forced through orifices 2068 in fixed pistons 2066A and 2066B will damp ski 2.

Figure 27:
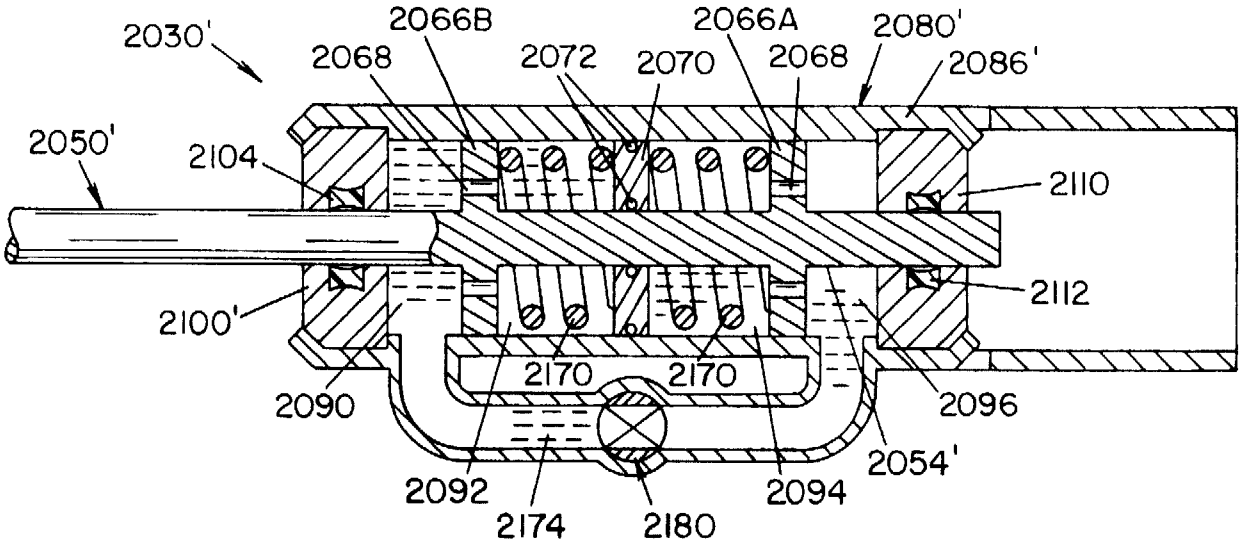
FIG. 27 is a sectional top view of another embodiment of the hydraulic damping/stiffening member of the damping/stiffening system.

FIG. 27 illustrates an alternative embodiment of the hydraulic damping and stiffening assembly. Hydraulic damping and stiffening assembly 2030' is generally comprised of a rod member 2050', cylinder member 2080', bias means 2170 and an ON/OFF valve 2180. Parts in FIG. 27 corresponding to those in FIG. 24 are given the same reference number as those in FIG. 24. Damping and stiffening assembly 2030' is located generally beneath the toe end of the ski boot. Rod member 2050' is similar to rod member 2050. However, rod member 2050' does not include a U-shaped channel for transferring hydraulic fluid. Instead, a bypass channel 2174 is provided by cylinder member 2080' for fluid transfer, as will be explained below. Furthermore, rod member 2050' does not rotate about its longitudinal axis to engage and disengage damping and stiffening assembly 2030'. Instead, ON/OFF valve 2180 is provided to engage and disengage damping and stiffening assembly 2030', as will also be discussed below. Free end 2054' of rod member 2050' includes fixed pistons 2066A and 2066B, and a floating piston 2070 as described above.

Cylinder member 2080' is generally comprised of a housing 2086', a first end guide 2100' and a second end guide 2110. Cylinder member 2080' also includes bypass channel 2174 mentioned above. End guides 2100' and 2110 support rod member 2050' inside housing 2086'.

It should be noted that end guide 2100' and fixed piston 2066B define a first chamber 2090; fixed piston 2066B and floating piston 2070 define a second chamber 2092; floating piston 2070 and fixed piston 2066A define a third chamber 2904; and fixed piston 2066A and second end guide 2110 define a fourth chamber 2096. Bypass channel 2174 carries hydraulic fluid between first chamber 2090 and fourth chamber 2096, when damper and spring assembly 2030' is disengaged.

Bias means 2170 is preferably comprised of a pair of coil springs arranged in chambers 2092 and 2094. Bias means 2170 increases the stiffness of the ski as it bends, when damper and spring assembly 2030' is engaged. It should be appreciated that other types of bias means are also suitable.

Figure 28:
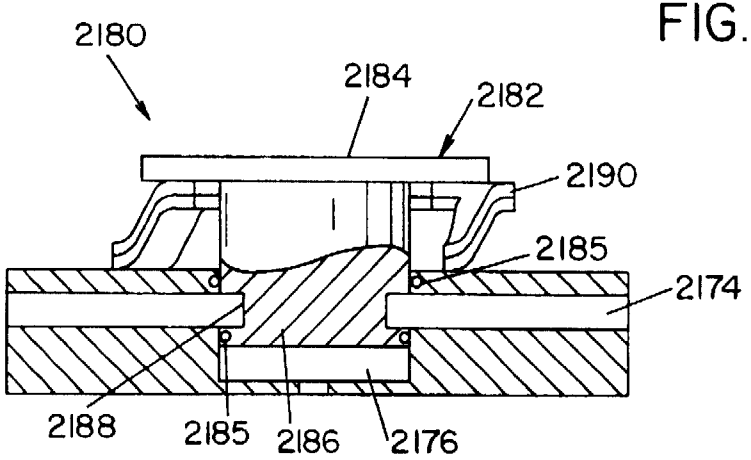
FIGS. 28 and 29 are side sectional views of an ON/OFF valve according to a preferred embodiment of the present invention.
Figure 29:
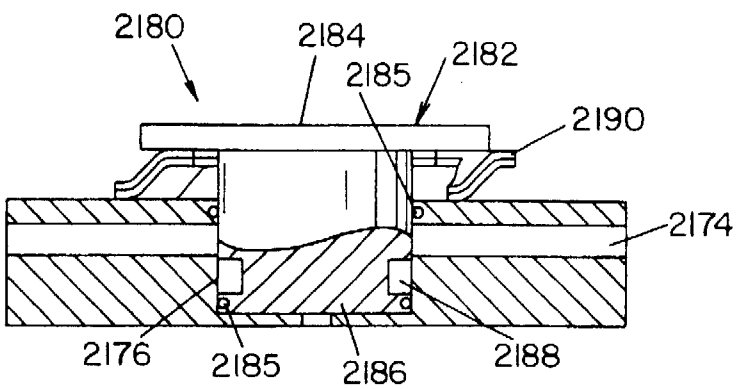

ON/OFF valve 2180 opens and closes the flow of hydraulic fluid through bypass channel 2174. A preferred embodiment of ON/OFF valve 2180 is shown in FIGS. 28 and 29. FIG. 28 shows ON/OF valve 2180 in an ON or open position, while FIG. 29 shows ON/OFF valve 2180 in an OFF or closed position.

ON/OFF valve 2180 is generally comprised of a switch member 2182 and a bias means 2190. Switch member 2182 has a support portion 2184 and a lower portion 2186. Support portion 2184 contacts with the sole of the ski boot, preferably at the toe end thereof. Lower portion 2186 includes an annular recess 2188, and is dimensioned to be received within a recess 2176 formed in bypass channel 2174. Seals 2185 are provided to prevent leakage of hydraulic fluid from channel 2174 and the leakage of hydraulic fluid into recess 2176. A bias means 2190, preferably in the form of a finger spring, biases switch member 2182 in the upward direction. The amount of upward force applied by bias means 2190 to switch member 2182 determines the amount of downward force which must be provided to switch member 2182 before damper and spring assembly 2030' is engaged. As indicated above, the preload force of bias means 2190 is preferably approximately one-half the skier's weight. It will be appreciated that bias means 2190 may take the form of other springs including compressions springs. In addition, the preload force of bias means 2190 may be adjustable.

Figure 33:
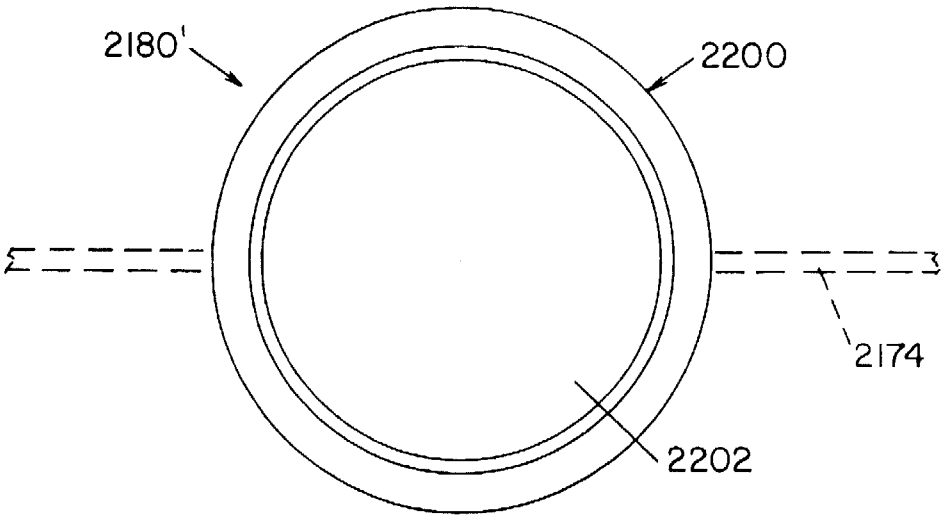
FIG. 33 is a top plan view of an ON/OFF valve arrangement according to another embodiment of the present invention.
Figure 34:
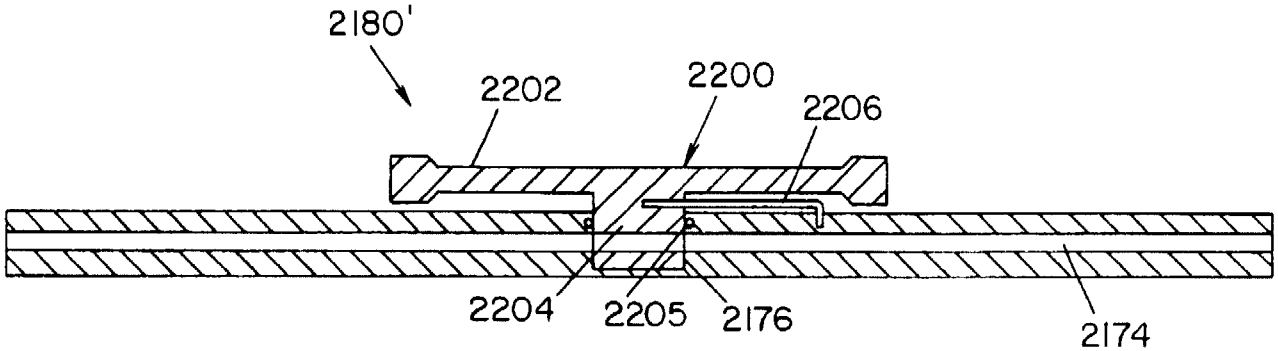
FIG. 34 is a side sectional view of the ON/OFF valve arrangement shown in FIG. 33.

Referring now to FIGS. 33 and 34, rotatable ON/OFF valve 2180' is an alternative embodiment for the ON/OFF valve. Rotatable ON/OFF valve 2180' is arranged to respond to the ski turning, rather than a force applied by the ski boot, as is the case with ON/OFF valve 2180 (FIGS. 28–29). ON/OFF valve 2180' is generally comprised of a switch member 2200 and a bias means 2206. Switch member 2200 is generally comprised of a flywheel portion 2202 and a stem portion 2204. Flywheel portion 2202 is arranged generally parallel to the plane of the ski. Stem portion 2204 is received within recess 2176 formed in bypass channel 2174. In a preferred embodiment, bias means 2206 takes the form of a cantilever centering spring, as shown in FIG. 34. Bias means 2206 attach to stem portion 2204 and to the housing surrounding bypass channel 2174. Bias means 2206 biases switch member 2200 in a "disengaged" position, thus allowing passage of fluid through channel 2174, as shown in FIG. 34. When a skier initiates a turn, flywheel portion 2202 impedes rotation of stem portion 2204. Accordingly, stem portion 2204 will become positioned relative to channel 2174 such that it blocks passage of fluid through channel 2174 (i.e., "engaged" position). As a result, damping and stiffening assembly 2130' will be "activated." Bias means 2206 returns switch member 2200 to the open (i.e., "disengaged") position after the angular acceleration has ended. Inertia of the flywheel, rate of the springs and damping of the oil in ON/OFF valve 2180' will determine the dynamic response of valve 2180'. It should be appreciated that the foregoing is but one alternative arrangement for responding to turning of the ski, and that other arrangements for responding to turning of the ski are also within the scope of the present invention.

Operation of damping and stiffening assembly 2030' will now be described with reference to FIGS. 27–29. Damping and stiffening assembly 2130' will be in a disengaged condition when switch member 2182 is in an upward position (FIG. 28), corresponding to the ON or open position of ON/OFF valve 2180. Hydraulic fluid is free to flow through bypass channel 2174, since annular recess 2188 is in communication with bypass channel 2174. Therefore, fluid is free to transfer between first chamber 2090 and fourth chamber 2096, as free end 2054' of rod member 2050' moves relative to the ski. For instance, when rod member 2050' moves forward, first chamber 2090 increases in volume, while fourth chamber 2096 decreases in volume. As a result, fluid transfers from fourth chamber 2096 into first chamber 2090 via bypass channel 2174. Since the fluid will travel through a path of least resistance, only a negligible amount of fluid passes through orifice 2068 of fixed piston 2066A. Accordingly, no significant damping will occur due to hydraulic fluid movement therethrough. Furthermore, since floating piston 2070 will be free to move, bias means 2170 in second chamber 2092 will not be compressed. Accordingly, bias means 2170 in second chamber 2092 will not act to increase the stiffness of the ski.

Similarly, when rod member 2050' moves rearward, first chamber 2090 decreases in volume, while fourth chamber 2096 increases in volume. As a result, hydraulic fluid transfers from first chamber 2090 into fourth chamber 2096 via bypass channel 2174. Only a negligible amount of fluid passes through orifice 2068 of fixed piston 2066B, since the fluid will travel through a path of least resistance. Accordingly, no significant damping will occur due to hydraulic fluid movement therethrough. Furthermore, since floating piston 2070 remains free to move, bias means 2170 in third chamber 2094 is not compressed. Accordingly, bias means 2170 does not act to increase the stiffness of the ski.

Damping and stiffening assembly 2030' will be in an engaged condition when switch member 2182 is in a downward position (FIG. 29) corresponding to the OFF or closed position of ON/OFF valve 2180. Hydraulic fluid is prevented from flowing through bypass channel 2174, since annular recess 2188 is not in communication with channel 2174. In this regard, lower portion 2186 is moved further into recess 2176. To put damper and spring assembly 2030' in an engaged condition, the skier must apply a downward force to switch member 2182 which is great enough to overcome the upward force exerted by bias means 2190. In an engaged condition, fluid is not able to flow through channel 2174, and consequently fluid is unable to move between first chamber 2090 and fourth chamber 2096. As a result, floating piston 2070 becomes hydraulically locked in place. When rod member 2050' moves forward during engagement of damper and spring assembly 2030', both damping and stiffening will occur. In this regard, bias means 2170 in second chamber 2092 is compressed, as rear fixed piston 2066B moves toward floating piston 2070 (which is locked in position). This will increase the stiffness of the ski. Furthermore, front fixed piston 2066A moves towards second end guide 2110. Since hydraulic fluid is unable to flow through channel 2174, it will be forced through orifice 2068 of fixed piston 2066A. The forced flow of fluid through orifice 2068 damps the ski.

When rod member 2050' moves rearward during engagement of damper and spring assembly 2030', both damping and stiffening will occur in a similar manner as described above. In this respect, bias means 2170 in third chamber 2094 is compressed, as front fixed piston 2066A moves toward floating piston 2070 (which is in a locked position). This will increase the stiffness of the ski. Furthermore, rear fixed piston 2066B will move toward first end guide 2100'. Since fluid is unable to flow through channel 2174, it is forced through orifice 2068 of fixed piston 2066B. The forced flow of fluid through orifice 2068 damps the ski.

As in the embodiment shown in FIGS. 23–26, after a skier has begun a turn, the skier's weight is transferred to the toe end of the ski boot. Switch member 2182, located generally beneath the toe end of the ski boot, will receive a downward force sufficient to overcome the upward "preload" force exerted by bias means 2190. As a result, damper and spring assembly 2030' will be engaged. When the turn is complete, the skier's weight will shift away from the toe end of the ski boot and the downward force on switch member 2182 will be less than the "preload" upward force exerted by bias means 2190. As a result, damper and spring assembly 2030' will return to a disengaged condition.

It should be appreciated that several modifications to the embodiments shown in FIGS. 22–27 are within the scope of the present invention. For instance, the damping and stiffening assembly may be modified to provide selectively variable damping and/or stiffening. Furthermore, the location of the rod member and cylinder member along the ski may vary. For instance, the rod member may be fixed in front of the toe piece and extend rearward, while the cylinder member may be arranged behind the heel piece. Moreover, the present invention may be modified to provide only damping or only stiffening. For a system providing only damping, the bias means are removed. For a system providing only stiffening the orifices in the fixed pistons are enlarged such that they do not significantly restrict the flow of fluid therethrough, as the pistons move through the hydraulic fluid. The fixed pistons merely provide a surface for engaging the bias means.

Figure 30:
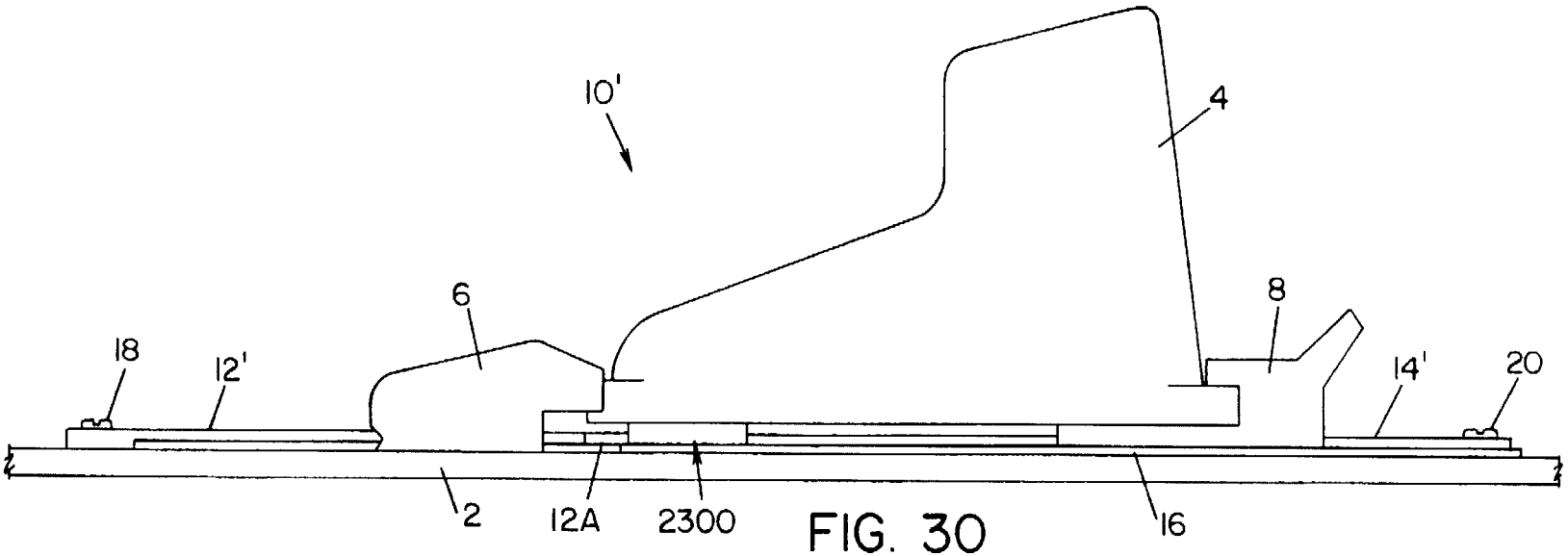
FIG. 30 is a side plan view of a damping system according to another embodiment of the present invention, as mounted to a ski with a ski binding toe piece, a ski binding heel piece and a ski boot arranged thereon.
Figure 31:
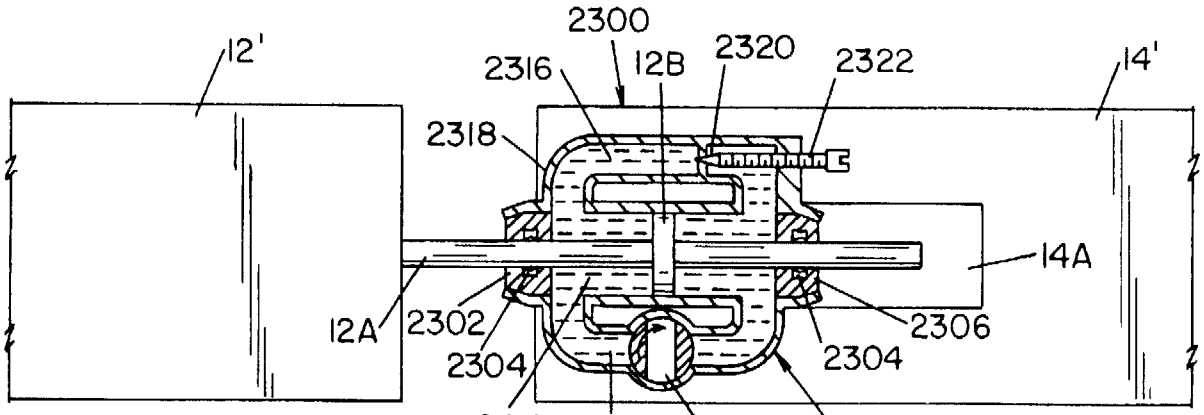
FIG. 31 is a sectional top view of the damping member of the damping system shown in FIG. 30.

Another embodiment of the present invention is shown in FIGS. 30 and 31. This embodiment of the present invention is directed to a system for damping the ski. Damping system 10' is shown mounted to ski 2 along with ski binding toe piece 6 and ski binding heel piece 8. Toe piece 6 and heel piece 8 secure ski boot 4 to ski 2.

According to this embodiment of the present invention, damping system 10' is generally comprised of a longitudinally extending front damping plate 12', a longitudinally extending rear damping plate 14', and a damping arrangement 2300. Damping arrangement 2300 is generally comprised of a cylinder member 2310 and an ON/OFF valve 2330.

Front damping plate 12' and rear damping plate 14' each have a fixed end and a free end. An anchor or fastener 18 attaches the fixed end of damping plate 12' to ski 2, while an anchor or fastener 20 attaches the fixed end of rear damping plate 14' to ski 2. Front damping plate 12' is preferably fixed to ski 2 in front of toe piece 6, while rear damping plate 14' is preferably fixed to ski 2 behind heel piece 8. However, the location of plates 12' and 14' may be reversed. Damping plate 12' extends rearward through a slot in toe piece 6 and into cylinder member 2310 fixed to rear damping plate 14', as will be explained in detail below. The free end of damping plate 12' is comprised of a rod member 12A having a piston 12B. Rod 12A extends through cylinder member 2360 fixed to the free end of damping plate 14' (FIG. 31). Piston 12B interacts with hydraulic fluid inside cylinder member 2310 to damp ski 2, as will be discussed below.

As indicated above, cylinder member 2310 is fixed to the free end of rear damping plate 14'. Cylinder member 2310 is generally comprised of a housing 2318, a central channel 2312, a first bypass channel 2314 and a second bypass channel 2316. Central channel 2312 is dimensioned to receive rod member 12A, including piston 12B, as shown in FIG. 31. First bypass channel 2314 includes an ON/OFF valve 2330. ON/OFF valve 2330 is preferably spring-loaded, and will be discussed in detail below. Second bypass channel 2316 includes a needle valve 2320. Needle valve 2320 has a set screw 2322 for adjusting the amount of fluid which can pass therethrough.

A pair of end guides 2302 and 2306 are respectively arranged at opposite ends of central channel 2312. End guides 2302 and 2306 support rod member 12A within cylinder member 2310. Seals 2304 are provided in each end guide 2302 and 2306 to prevent fluid from leaking out from cylinder housing 2318 and to provide a bearing surface for rod member 12A as it moves in the longitudinal direction of ski 2.

ON/OFF valve 2330 preferably takes the form of spring-loaded ON/OFF valve 2330 shown in FIGS. 28 and 29, and described above. ON/OFF valve 2330 is preferably located below the ski boot, sole at the toe end thereof. Moreover, a hole formed in ON/OFF valve 2330 may substitute for needle valve 2320. In this respect, a hole may be formed in ON/OFF valve 2330 that allows a small amount of fluid to pass therethrough when ON/OFF valve 2330 is in the "OFF" or closed position. Furthermore, a magnetically actuated ferrofluid valve in a single bypass channel could perform the function of ON/OFF valve 2330 (i.e., changing between an "ON" or open valve position to an "OFF" or closed valve position) and the function of the needle valve 2320.

Detailed operation of damping system 10' will now be described. Damping arrangement 2300 is disengaged when ON/OFF valve 2330 is in an "ON" or open position. In this condition, hydraulic fluid is free to flow across first bypass channel 2314. Therefore, as piston 12B moves forward and rearward, due to the movement of the free end of damping plate 12', the displaced hydraulic fluid will move through first bypass channel 2314. A negligible amount of hydraulic fluid will flow through needle valve 2320, since the fluid will travel the path of least resistance. Accordingly, no significant amount of damping will occur. Damping arrangement 2300 is in an engaged condition when ON/OFF valve 2330 is in an "OFF" or closed position. When ON/OFF valve 2330 is closed, no fluid can travel through first bypass channel 2314. Consequently, as piston 12B moves forward and rearward, the displaced fluid is forced through needle valve 2320 in second bypass channel 2316. The forcing of hydraulic fluid through needle valve 2320 damps ski 2. The amount of damping may be varied by changing the amount of fluid which flows through needle valve 2320. In this regard, set screw 2322 is used to change the size of the opening of needle valve 2320.

Figure 32:
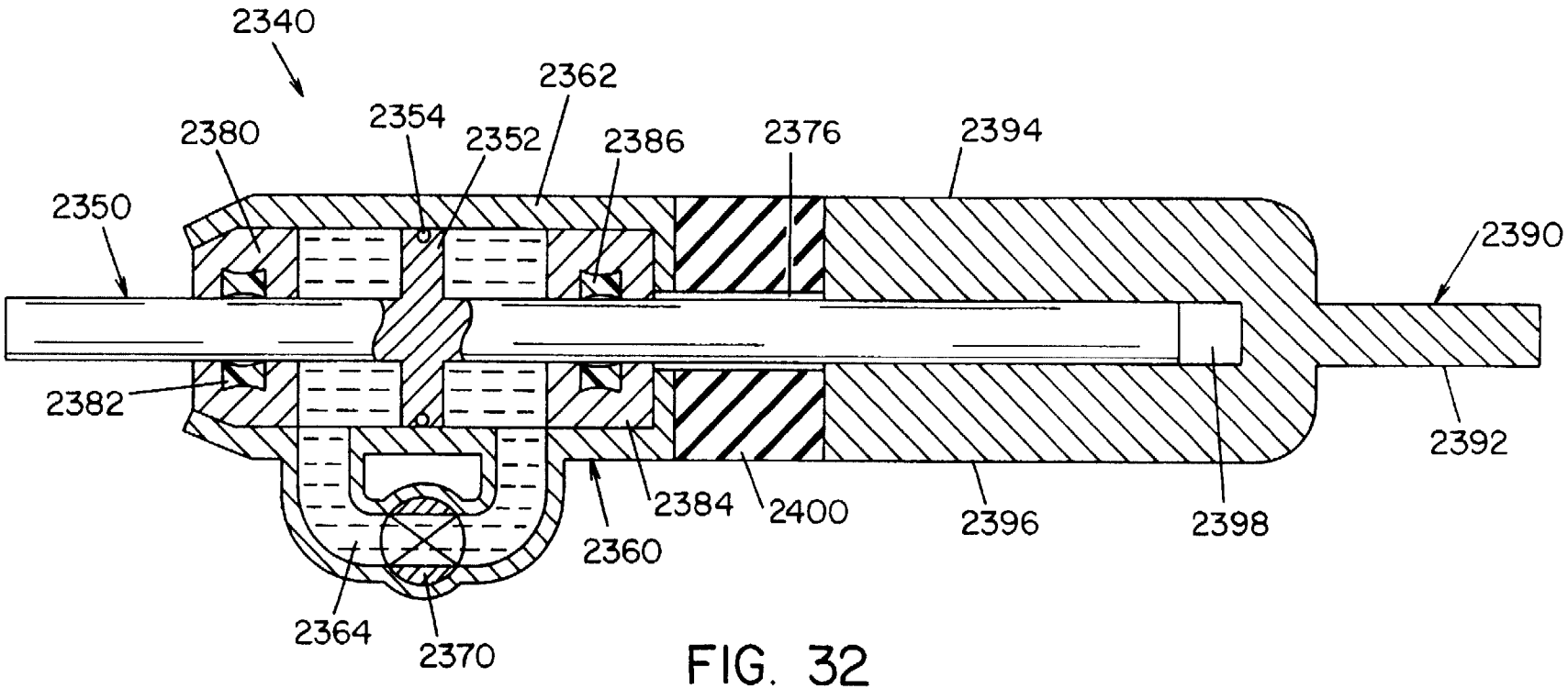
FIG. 32 is a sectional top view of a damping/stiffening member according to another embodiment of the present invention.

FIG. 32 illustrates yet another embodiment of the present invention. The embodiment shown in FIG. 32 provides a system for both damping and stiffening the ski. A damping and stiffening assembly 2340 is generally comprised of a rod member 2350, a cylinder member 2360, an ON/OFF valve 2370, a spring 2400 and a plate 2390. Cylinder member 2360, spring 2400 and plate 2390 are bonded to each other as shown in FIG. 32. Rod member 2350 has a fixed end (not shown) and a free end shown in FIG. 32. The fixed end is attached to the ski in the same manner as damping plate 12' in the embodiment shown in FIG. 30. The free end of rod member 2350 includes a piston 2352 having an O-ring seal 2354. The free end of rod member 2350 is received by cylinder member 2360, spring 2400 and plate 2390, as shown in FIG. 32.

Plate 2390 has a fixed end (not shown) and a free end. The fixed end is fixed to ski in the same manner as damping plate 14' in the embodiment shown in FIG. 30. The free end of plate 2390 is comprised of a central plate 2392 and a pair of parallel plates 2394 and 2396. Parallel plates 2394, 2396 form a rod receiving slot 2398. Spring 2400 is arranged between the ends of parallel plates 2394, 2396 and cylinder member 2360.

Cylinder member 2360 is comprised of a housing 2362 and a bypass channel 2364. Cylinder member 2360 is bonded to spring 2400, as noted above. Cylinder member 2360 is not fixed to the ski, and consequently is free to move with plate 2390. ON/OFF valve 2370 is arranged along bypass channel 2364 as shown in FIG. 32. ON/OFF valve 2370 preferably takes the form of ON/OFF valve 2180 shown in FIGS. 28 and 29, and described above. Preferably, ON/OFF valve 2370 is located beneath the ski boot at the toe end thereof. A first end guide 2380 and a second end guide 2384 are arranged within housing 2362 to support rod member 2350. First end guide includes a seal 2382 and second end guide 2384 includes a seal 2386. Seals 2382 and 2386 prevent fluid from leaking out of cylinder member 2360 and provide a bearing surface for rod member 2350 as it moves in the longitudinal direction of the ski.

Spring 2400 is bonded to cylinder member 2360 and plate 2390 and preferably constructed of adiprene urethane rubber and has a preferred durometer in the range of 60A to 95A. Spring 2400 has a generally cylindrical shape, and is dimensioned to provide a gap 2376 between spring 2400 and rod member 2350. Accordingly, spring 2400 does not impede movement of rod member 2350.

The operation of damping/stiffening member 2340 will now be described. When ON/OFF valve 2370 is in an "ON" or open position, damping/stiffening member 2340 will be in a disengaged condition. In this respect, fluid will be free to flow through bypass channel 2364. Accordingly, as rod member 2350 moves forward and rearward relative to the ski, the hydraulic fluid displaced by piston 2352 is free to flow through bypass channel 2364. Consequently, as the ski flexes rod member 2350 will move inward and outward of slot 2398, as rod member 2350 and plate 2390 move towards and away from each other.

When ON/OFF valve 2370 is in an "OFF" or closed position, fluid is unable to flow through bypass channel 2364. Consequently, rod member 2350 becomes locked to cylinder member 2360. Accordingly, plate 2390 will move against spring 2400 as the ski bends. The properties of spring 2400 will both dampen and stiffen the ski.

It should be understood that as the ski flexes, rod member 2350 and plate 2390 will move towards and away from each other. When damping/stiffening member 2340 is disengaged, rod member 2350 will be free to move relative to cylinder member 2360, which is bonded to spring 2400. When damping/stiffening 2340 is engaged, rod member 2350 will be fixed relative to cylinder member 2360, and thus the movement of plate 2390 will be biased by spring 2400, which both damps the ski and increases the stiffness of the ski. Accordingly, this embodiment of the invention provides a single element (i.e., spring 2400) which provides both damping and stiffening.

The foregoing description provides specific embodiments of the present invention. It should be appreciated that these embodiments are described for the purpose of illustration only, and that numerous alterations and modifications may be practiced by those skilled in the art without departing from the spirit and scope of the invention. For instance, the present invention may be modified to include a spring loaded switch to turn on and off electronic dampers, such as piezoelectric dampers. Furthermore, in the embodiments of the present invention having means for both damping and stiffening the ski, the present invention may be modified to include only means for damping or only means for stiffening. Moreover, the embodiments of the present invention having spring members to stiffen the ski may be modified to allow for variations in the amount of spring force exerted by the spring member. For instance, the number of spring members exerting a spring force may be made variable. It should also be understood that the damping and/or stiffening arrangement may be located anywhere along the length of the ski. Similarly, the means for engaging and disengaging the damping and/or stiffening arrangement may be located at various positions beneath the ski boot sole, depending upon the threshold force desired to engage the damping and/or stiffening member.

Although the embodiments described above relate to the incorporation in ski bindings, the systems could be incorporated in skis or in ski boots, or in combinations of bindings, skis and/or boots.

It is intended that all such modifications and alterations of the present invention as disclosed herein be included insofar as they come within the scope of the invention as claimed or the equivalents thereof.

What is claimed is:

1. A system for damping vibrations in a ski, the ski vibrating as the skier travels on an irregular surface, said system comprising:

a first member extending generally longitudinally on a ski, said first member having a fixed portion fixed longitudinally to the ski and a free portion movable relative to the ski as the ski vibrates;

a second member spaced longitudinally from said first member on the ski, said second member having a fixed portion fixed to the ski and at least one movable portion;

damping means operatively connected to the free portion of said first member and the least one movable portion of said second member, and having an active condition for damping longitudinal motion between the fixed portion of said first member and the fixed portion of said second member, and an inactive condition for permitting free longitudinal motion therebetween; and switch means for switching said damping means to the active condition in response to a threshold force exceeding a predetermined value exerted by a skier's boot in response to shifting of the skier's body during skiing maneuvers, and for switching said damping means to the inactive condition when the threshold force is below the predetermined value.

2. A system according to claim 1 wherein said damping means comprises a dashpot.

3. A system according to claim 1 wherein said damping means comprises a viscoelastic damping device.

4. A system according to claim 1 wherein said damping means comprises a friction damping device.

5. A system according to claim 1 wherein said damping means comprises a piezoelectric device.

6. A system according to claim 1 wherein said threshold of a predetermined value is a downward force greater than a reference force of a predetermined value, and wherein said switch means comprises:

foot-actuated means for operating said switch means, said foot-actuated means having an actuating condition for causing said switch means to switch said damping means to the active condition and a non-actuating condition for causing said switch means to switch said damping means to the inactive condition; and reference force means for applying said reference force of the predetermined value upwardly on said foot-actuated means to urge said foot-actuated means to the non-actuating condition;

said foot-actuated means assuming the actuating condition when a downward force exceeding said reference force is applied to said foot-actuated means.

7. A system according to claim 6 wherein said reference force means comprises biasing means for applying a biasing force equal to said reference force on said foot-actuated means.

8. A system according to claim 7 wherein said biasing means is located in said first member.

9. A system according to claim 7 wherein said biasing means is located in said second member.

10. A system according to claim 7 wherein said threshold of a predetermined value is a torque greater than a reference torque of a predetermined value, and wherein said switch means comprises:

foot-actuated means for operating said switch means, said foot-actuated means having an actuating condition for causing said switch means to switch said damping means to the active condition and a non-actuating condition for causing said switch means to switch said damping means to the inactive condition; and reference torque means for applying said reference torque of the predetermined value to said foot-actuated means to urge said foot-actuated means to the non-actuating condition;

said foot-actuated means assuming the actuating condition when a downward torque exceeding said reference torque is applied to said foot-actuated means.

11. A system according to claim 1 and further including stiffening means having an active condition for stiffening the ski against bending, and an inactive condition for lessening the stiffening of the ski; and switch means for switching said stiffening means to the active condition in response to a force exceeding a predetermined threshold value, and for switching said stiffening means to the inactive condition when the force is below the threshold value.

* * * * *